United States Patent [19]

Huffman et al.

[11] Patent Number: 4,463,844

[45] Date of Patent: Aug. 7, 1984

[54] APPARATUS AND METHOD FOR RETURN OF EMPTY ALUMINUM CANS

[75] Inventors: Stanley S. Huffman, Golden; Jan L. Dorfman, Littleton; Robert L. Frenkel, Englewood; Ronald A. Pearce, Lakewood, all of Colo.

[73] Assignee: Adolph Coors Company, Golden, Colo.

[21] Appl. No.: 333,639

[22] Filed: Dec. 23, 1981

[51] Int. Cl.[3] ..... G07F 7/06

[52] U.S. Cl. ..... 194/4 C; 209/213; 241/79.1

[58] Field of Search ..... 100/DIG. 2, 151–153; 194/4 C; 209/930, 636, 644, 212–215; 241/79.1

[56] References Cited

U.S. PATENT DOCUMENTS

| | | | |
|---|---|---|---|
| 2,515,748 | 7/1950 | Wallace et al. | 100/151 X |
| 3,515,056 | 6/1970 | Johnson | 100/153 X |
| 4,059,050 | 11/1977 | Davis, Jr. | 209/213 X |
| 4,257,511 | 3/1981 | Miller | 241/79.1 |
| 4,261,259 | 4/1981 | Beardslee | 100/152 |

*Primary Examiner*—Stanley H. Tollberg
*Attorney, Agent, or Firm*—Klaas & Law

[57] ABSTRACT

A method and apparatus for processing used empty aluminum and steel cans wherein groups of empty cans are carried upwardly on an inclined conveyor between spaced inclined ribs and separately sequentially discharged therefrom into an air duct wherein empty cans are blown to a crusher whereat the empty cans are sequentially crushed and fall onto a magnetic separator whereat crushed aluminum cans are separated from crushed steel cans and fall into a weigh hopper whereat the weight of crushed aluminum cans is determined whereupon compensation is dispensed for the value of the crushed aluminum cans. Thereafter, the crushed aluminum cans are sequentially dropped into an air duct and blown to a storage bin.

39 Claims, 28 Drawing Figures

APPARATUS AND METHOD FOR RETURN OF EMPTY ALUMINUM CANS

BACKGROUND AND SUMMARY OF INVENTION

In general, the present invention relates to apparatus and methods for receiving, processing and dispensing compensation for empty used containers. Such apparatus and methods are hereinafter sometimes referred to as "reverse vending" apparatus and methods in that a customer is compensated for return of empty containers as compared with "vending" apparatus and methods whereby a customer receives a full container upon deposit of compensation.

The apparatus and methods of the present invention are particularly adapted for use in connection with recovery of aluminum can-type beverage containers which presently have a scrap value substantially in excess of other types of commonly used containers made of steel, glass, plastic, paper and the like.

There is a substantial amount of prior art in the reverse vending field which includes: (1) batch type apparatus and methods whereby multiple empty containers may be simultaneously received and processed; and (2) single container type apparatus and methods for receiving and processing one container at a time. Myers U.S. Pat. No. Re. 27,643 and Wu, et al. U.S. Pat. No. 4,241,821 are examples of single container reverse vending apparatus and methods. Spears, et al. U.S. Pat. No. 3,749,240 and Miller U.S. Pat. No. 4,179,018 are examples of batch type apparatus and methods. The Myers patent discloses the basic concept of can collection apparatus for receiving a used can, separating cans of various materials, crushing the cans and dispensing something of monetary value, such as coins or a token, in accordance with the value of the cans received. Since then, a substantial effort has been made to further develop such can collection apparatus for the purpose of implementing a recycling system whereby used cans may be efficiently collected from the general public and returned to sheet metal manufacturers for reuse in the manufacture of sheet metal.

In general, prior art reverse vending apparatus and methods have included a housing containing container receiving means for receiving used empty containers; classification or separation means for separating particular types of containers, such as empty aluminum containers, from other types of containers such as steel or glass containers; container crushing means for crushing selected types of containers; container storage means for storing the containers; conveyor means for transporting the containers to the container crushing means and the container storage means; measuring means for determining the amount of selected types of containers received; and dispensing means for dispensing compensation proportional to the value of the selected types of containers received.

Prior art reverse vending apparatus and methods have employed a variety of combinations of specially constructed and arranged separator means, such as positive or negative air flow, magnetics and gravity, to separate aluminum from steel or glass containers. Spears, et al. U.S. Pat. No. 3,749,240 discloses apparatus for and method of classifying empty containers at a single classification station at the upper end of an upwardly inclined conveyor by use of a combination of gravity, pressurized air and magnetic apparatus and methods. Miller U.S. Pat. No. 4,179,018 also discloses a method and apparatus for selective recovery of metal containers by use of a combination of gravity, pressurized air and magnetic apparatus and methods. In Miller, aluminum cans are first separated from steel cans and other articles, then blown to a crusher device, then the crushed cans are weighed to determine the amount of compensation to be dispensed, and then the crushed cans are blown to an overhead storage area. In addition, the use of pressurized air to convey empty aluminum can bodies has been known in the aluminum can manufacturing industry since at least 1965.

One of the problems with prior art batch type reverse vending apparatus for collection of cans has been the high cost of manufacture and the lack of adequate can storage capacity without the use of a relatively large housing. In addition, such apparatus has been energy inefficient and required the use of a relatively large number of parts spread out over a relatively large area requiring a relatively large volume housing. The prior art apparatus has not provided for crushing of both aluminum and steel cans. Also, there have been operational problems with the crushing apparatus and the crushed cans have not had optimum density characteristics. Another problem has been lack of accuracy of measurement of weight of aluminum cans and dispensing of the proper amount of compensation. Such apparatus has been subject to vandalism and thievery. The speed of operation of some apparatus has been relatively slow and control systems have been inadequate and unreliable.

The present invention provides a relatively small size compact arrangement of container separation means, container conveying means, container crushing means, container weighing means, and container storage means which are operable in a more energy efficient manner than prior art apparatus.

In general, the apparatus of the present invention comprises a multiple can collection bin means for receiving and temporarily holding articles to be processed; an upwardly inclined belt conveyor means associated with an open lower portion of the collection bin means for removing articles from the bin means and carrying articles upwardly away from the collection bin means to an upwardly spaced discharge location whereat the articles are outwardly downwardly discharged as the belt conveyor means turns around an uppermost pulley device; a combination air classifier and empty can conveyor means located in juxtaposition to the belt conveyor means for receiving articles discharged from the belt conveyor means and separating lightweight empty aluminum and steel cans from heavier articles such as bottles and filled cans while upwardly conveying empty cans toward a discharge opening; a crusher means located opposite the discharge opening for receiving and crushing empty aluminum and steel cans; a magnetic separator means located directly beneath and in juxtaposition to the lower portion of the crusher means for receiving and separating crushed aluminum and steel cans; a weighing means located beneath and in juxtaposition to the magnetic separator means for receiving and weighing crushed aluminum cans; and an air blower type crushed can conveying means located in juxtaposition to the weighing means for conveying crushed aluminum cans to a storage bin.

In the presently preferred embodiment, the collection bin means and the belt conveyor means are constructed and arranged so that the conveyor means ordinarily removes groups of articles from the bin means and carries each group of articles upwardly on one of a plurality of longitudinally spaced support rib devices attached to, extending outwardly from, and being laterally inclined across a continuous loop belt member so that each article of each group of articles is ordinarily separated from the other articles of each group during discharge from the conveyor means. The air classifier and empty can conveyor means comprises a single low pressure high volume air blower means which is preferably connected to a relatively short length inclined air passage means extending parallel to the belt conveyor means. An article inlet opening is provided in an upper portion of the air passage means adjacent and below the article discharge location of the belt conveyor means to receive articles discharged from the belt conveyor means. A heavy article outlet opening is provided at the lower end of the air passage means opposite and below the article inlet opening adjacent the air blower means whereby heavy articles, such as bottles and filled cans, fall by gravity from the inlet opening to the outlet opening through the air stream in the air passage means. Empty aluminum and steel cans are blown upwardly and conveyed in the air stream in the air passage means to the crusher means.

In a presently preferred embodiment of the invention, the crusher means comprises an oscillating blade member mounted in a hopper device for pivotal movement between spaced inclined side walls of the hopper device whereby empty cans may be crushed during movement of the blade member in either direction. Anti-jamming control means are provided to automatically reverse the direction of movement of the blade member whenever a jam condition in the crusher is sensed. In addition, if a jam condition is sensed for a predetermined period of time, operation of all apparatus is automatically terminated until manual repairs are made.

In another embodiment of the invention, the crusher comprises a pair of inwardly inclined steel alloy open link endless conveyor belt members which define a tapered can crushing passage of gradually reduced cross-sectional area therebetween having a relatively wide inlet opening at one end located next adjacent the air passage and a relatively narrow outlet opening at the other end. The inlet opening is substantially larger than the uncrushed cans to enable uncrushed cans to be blown into the can passage. At an intermediate portion of the can passage, its cross-sectional area becomes less than the cross-sectional area of the uncrushed cans and is gradually further reduced in cross-sectional area toward the outlet opening to provide a can crushing zone whereat the cans are gradually completely flattened by forces applied through the conveyor belt links which also carry the cans to and through the outlet opening. The conveyor belt members may be constructed and arranged to enable adjustment to achieve variable high density of crushed cans.

In the preferred embodiment, the magnetic separator means comprises a continuous non-magnetic belt member driven by an electric motor means about a magnetic pulley means. An upper horizontal portion of the belt member is located directly beneath the crusher means to directly receive crushed aluminum and steel cans by gravity fall from the crusher means and carry the crushed cans toward the magnetic pulley means. The lower portion of the belt member is upwardly inclined from the magnetic pulley means toward another pulley means and located directly above a crushed steel can discharge chute means. Crushed aluminum cans are discharged outwardly and downwardly relative to the belt member by momentum and gravitational forces as it turns around the magnetic pulley means and fall into the weighing means. Crushed steel cans are held on the belt member by magnetic forces as it turns around the magnetic pulley means and begins moving upwardly along the inclined path of the lower belt portion. When the magnetic force is no longer effective to hold the crushed steel cans on the lower belt portion, the steel cans fall away from the belt by gravitational and momentum forces. In the preferred embodiment, an outwardly extending rib member is provided on the belt to force steel cans away from the magnetic pulley means after the steel can has been carried therearound.

In the preferred embodiment, the weighing means comprises a hopper means suspended directly below and in close proximity to the magnetic separator means by a conventional load cell means which outputs electrical signals representative of the weight of the hopper means and empty cans therein. A door means, provided at the bottom of the hopper means, is movable between open and closed positions by an electric stepping motor means and associated linkage means which are constructed and arranged to open the door means at a variable rate whereby flow of cans to the air blower-type crushed can conveying means may be regulated. The weighing means further comprises a microprocessor control system wherein the load cell output signals are utilized to determine the amount of compensation to be dispensed to the customer for crushed aluminum cans received in the hopper means and to determine when to empty the hopper means. The construction and arrangement of the control system is such as to initiate certain procedures for each cycle of operation to assure that the machine is operating properly and that the customer receives the correct amount of compensation. These procedures comprise: initially obtaining a tare weight value representative of the empty weight of the hopper means; periodically obtaining an average crushed cans plus hopper weight value while cans are being processed in the machine; determining changes in succeeding average crushed cans plus hopper weight values and calculating the weight difference between the tare weight value and the last average crushed cans plus hopper weight value after there has been no change in average crushed cans plus hopper weight values for a predetermined period of time and then terminating operation of the can processing equipment; calculating the monetary value of the crushed cans in the hopper by multiplying the weight difference by a preset value per pound; dispensing compensation in accordance with the monetary value; and actuating the door actuating mechanism to dump cans from the hopper before the next cycle. In addition, whenever the weight of cans in the hopper exceeds a predetermined maximum value indicating that the hopper capacity has been reached, the operation of the can processing equipment is temporarily interrupted to enable operation of the door actuating mechanism to open the door, dump the crushed cans, and reclose the door whereupon the tare weight value is recalculated and the can processing equipment is reactivated. Other features of the control system which enable automatic continuous operation of the machine are hereinafter described in detail.

After the crushed aluminum cans are weighed to determine the amount of compensation to be dispensed, they are dumped and drop by gravity into a crushed can conveyor blown air passage means located at the bottom of the housing means whereby the crushed cans are blown to a large storage bin by a second air blower. In one embodiment, the crushed steel cans are also blown to a steel can storage bin by the second blower which is selectively connectable thereto. In addition, the second air blower may be selectively connected to unloading means associated with the storage bin for blowing the crushed cans from the storage bins to a discharge opening which is selectively connectable to a collection truck or portable storage bin.

The construction and arrangement of the can processing equipment is such as to enable the use of an unusually compact modular type housing means including a relatively small mechanical and electrical component section and a relatively large storage bin section. In the presently preferred embodiment, a single electric motor may be used to drive the belt conveyor means, the can crusher means, and the magnetic separator means with separate electric motors for each of the air blower means. Many of the parts and components may be made of high strength molded plastic parts to thereby reduce cost, maintenance and weight of the equipment, and improve air flow characteristics.

BRIEF DESCRIPTION OF DRAWING

Various illustrative embodiments of the invention are shown in the accompanying drawing in which.

DETAILED DESCRIPTION

First Embodiment

Figure 1A:
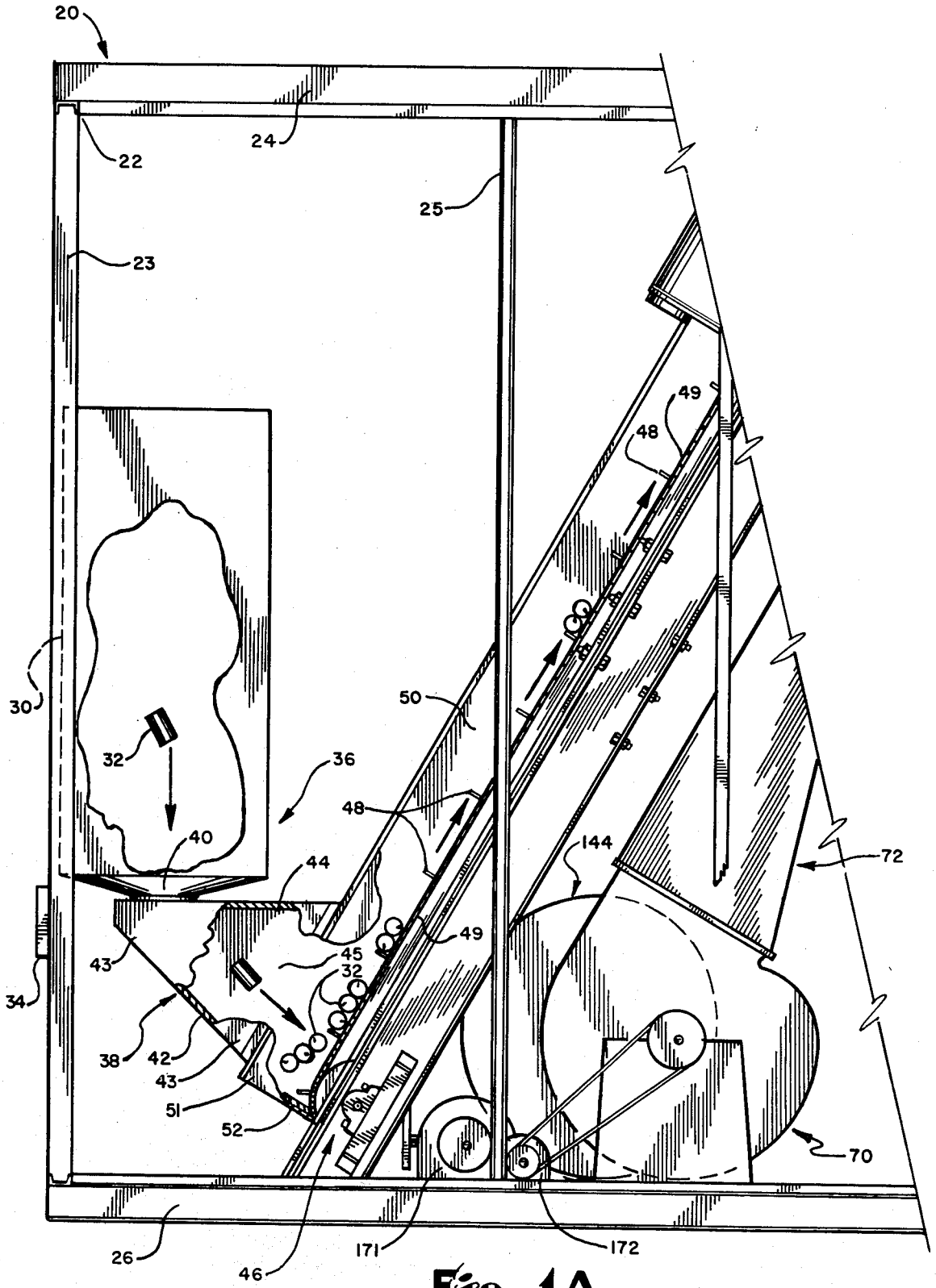
FIGS. 1A & 1B are side elevational views, with parts removed, of a first embodiment of the invention.
Figure 1B:
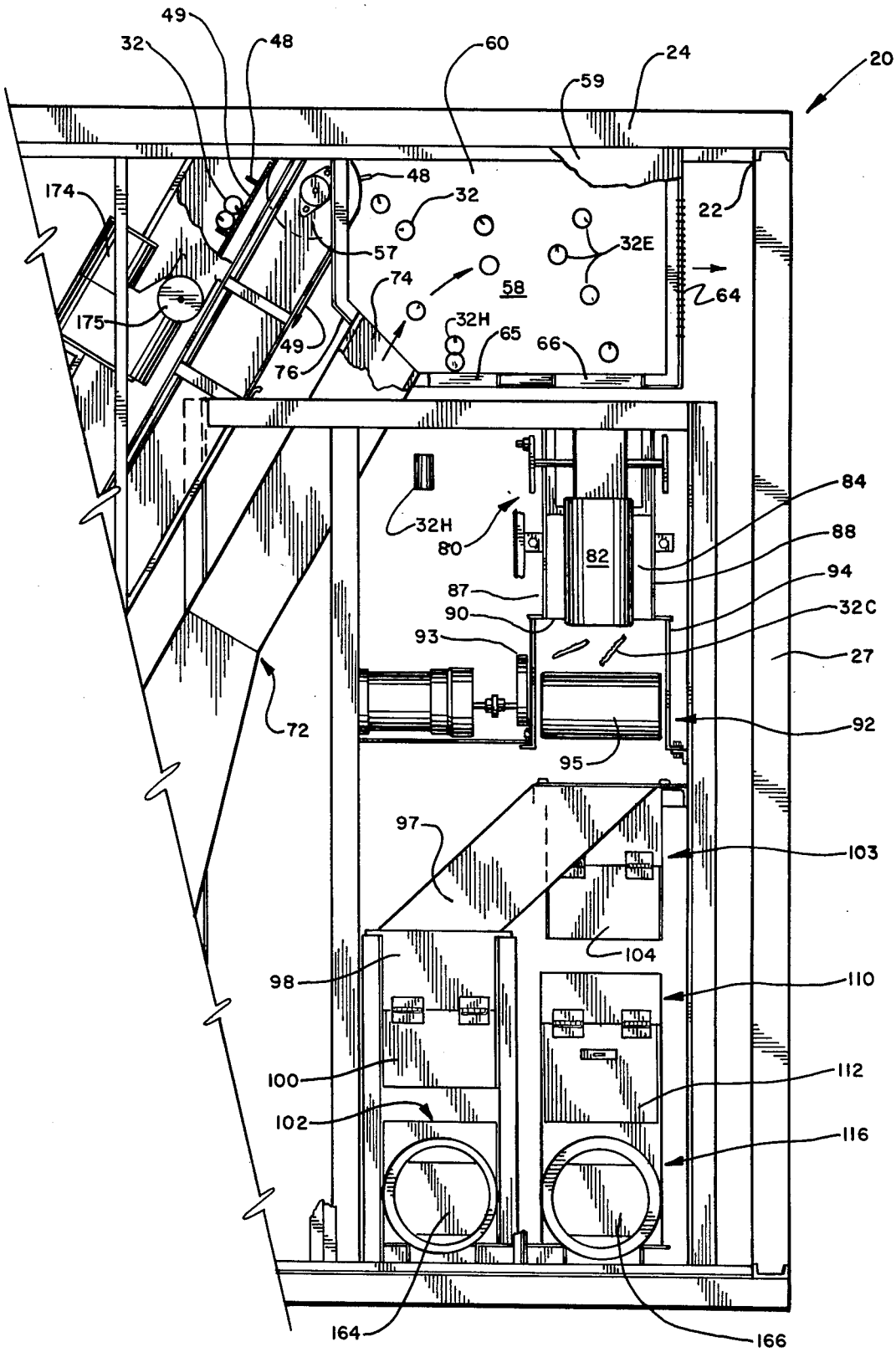
Figure 2:
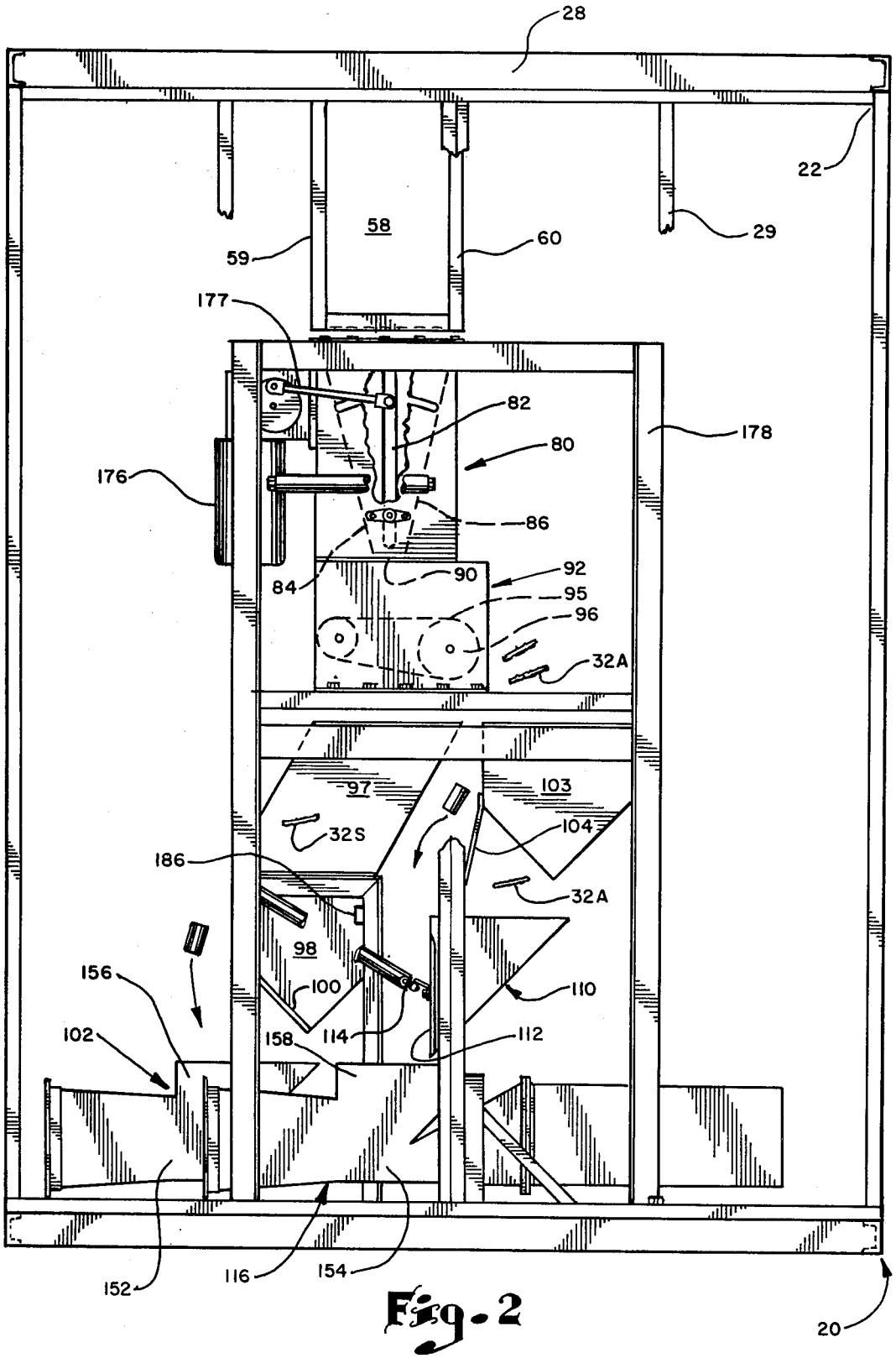
FIG. 2 is an end view, with parts removed of the apparatus of FIG. 1.
Figure 3:
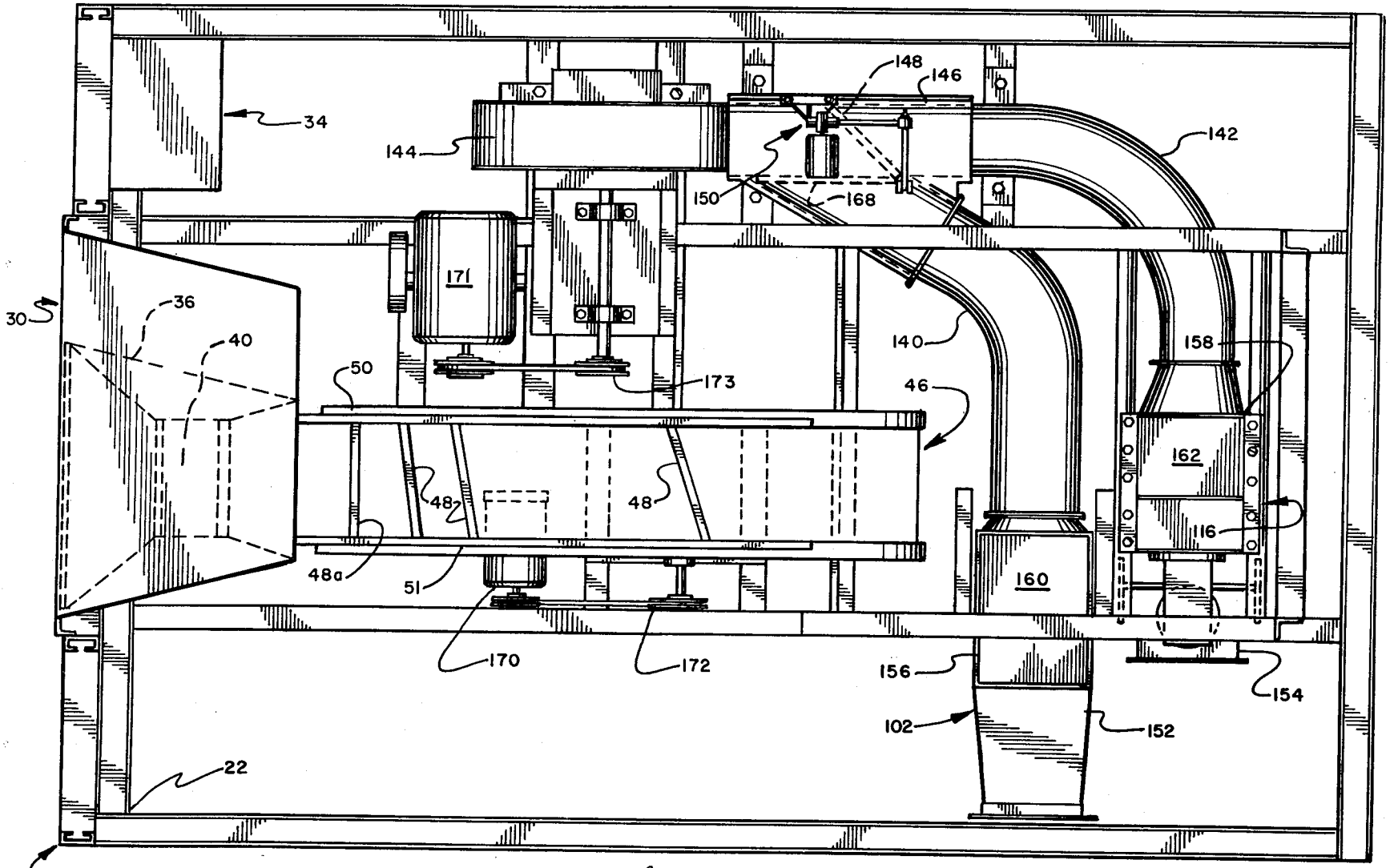
FIG. 3 is a top view, with parts removed, of the apparatus of FIG. 1.

Referring to FIGS. 1–5, a first embodiment of the invention comprises a housing means 20 for completely enclosing various can handling apparatus which is of generally rectangular box shaped configuration including a frame portion 22 made of conventional metallic structural members 23, 24, 25, 26, 27, 28, 29, etc. with floor, roof and side wall panels (not shown) mounted thereon. An inlet means 30 for receiving used cans 32 and a compensation dispensing means 34 for dispensing compensation to a customer are provided in one end wall. A can receiving chute and hopper means 36 is connected to the inlet means for temporarily receiving and enabling downward gravity flow of cans into an inlet chute means 38 located therebelow and connected thereto by a relatively small opening 40 above a downwardly inclined lower wall 42 extending between a pair of spaced side plate members 43, 44 toward a relatively large discharge opening 45. An upwardly inclined continuous belt-type conveyor means 46, having spaced rib members 48, which are preferably laterally inclined as shown in FIG. 3, on a continuous belt 49 is mounted between side plate members 50, 51 with a lower end wall 52 extending therebetween to provide an accumulation chamber 54 for cans received from opening 45. Belt 49 is mounted on a lower sprocket 56 and carries cans upwardly around a non-magnetic upper sprocket 57 whereat the cans are discharged from the belt and fall by gravity into an elongated chamber means 58 defined by side wall panels 59, 60, mounted on a frame means 62 with a screened opening 64 in a side wall thereof, and openings 65, 66 in the bottom wall thereof.

A low pressure high volume (e.g., 1" W.C. 3000 cfm) air blower means 70, mounted on the housing floor, is connected to an upwardly inclined duct means 72 which terminates in a screened outlet opening 74 in a downwardly inclined lower wall 76 of chamber 58 so that air is discharged into chamber 58 at a substantially right angle to the path of downward movement of cans therein. Outlet opening 65 enables heavy objects, such as rocks, bottles or filled cans 32H which fall through the air stream, to be discharged from chamber 58 into a collection chamber (not shown). Empty aluminum and steel cans 32E are blown across chamber 58 and fall by gravity to and through discharge opening 66.

A conventional can crusher means 80, comprising an oscillating blade member 82 pivotally displaceable between inclined compacting walls 84, 86, and side walls 87, 88, is mounted below opening 66 for receiving and crushing both aluminum and steel cans which fall into the crusher means by gravity. An opening 90 at the bottom of crusher means 80 enables crushed cans 32C to fall by gravity from the crusher means onto one end of a continuous horizontally extending belt type conveyor means 92 mounted between side plates 93, 94 which includes a continuous belt 95 and a magnetic pulley or sprocket means 96 for holding crushed steel cans on the belt during movement around the sprocket means until located over a discharge chute means 97 through which the steel cans fall by gravity to a steel can accummulator hopper means 98 having a selectively openable and closeable door means 100 operable by an air cylinder means or the like (not shown) to enable steel cans to be selectively dumped by gravity into unloader means 102 to be hereinafter described. Crushed aluminum cans 32A, which are not affected by the magnetic force of sprocket 96, are discharged from belt 95 by gravity fall into an aluminum can accumulator hopper means 103 which has a selectively openable and closeable pivotally mounted door means 104 operable by suitable actuator means such as an air cylinder (not shown).

Figure 4:
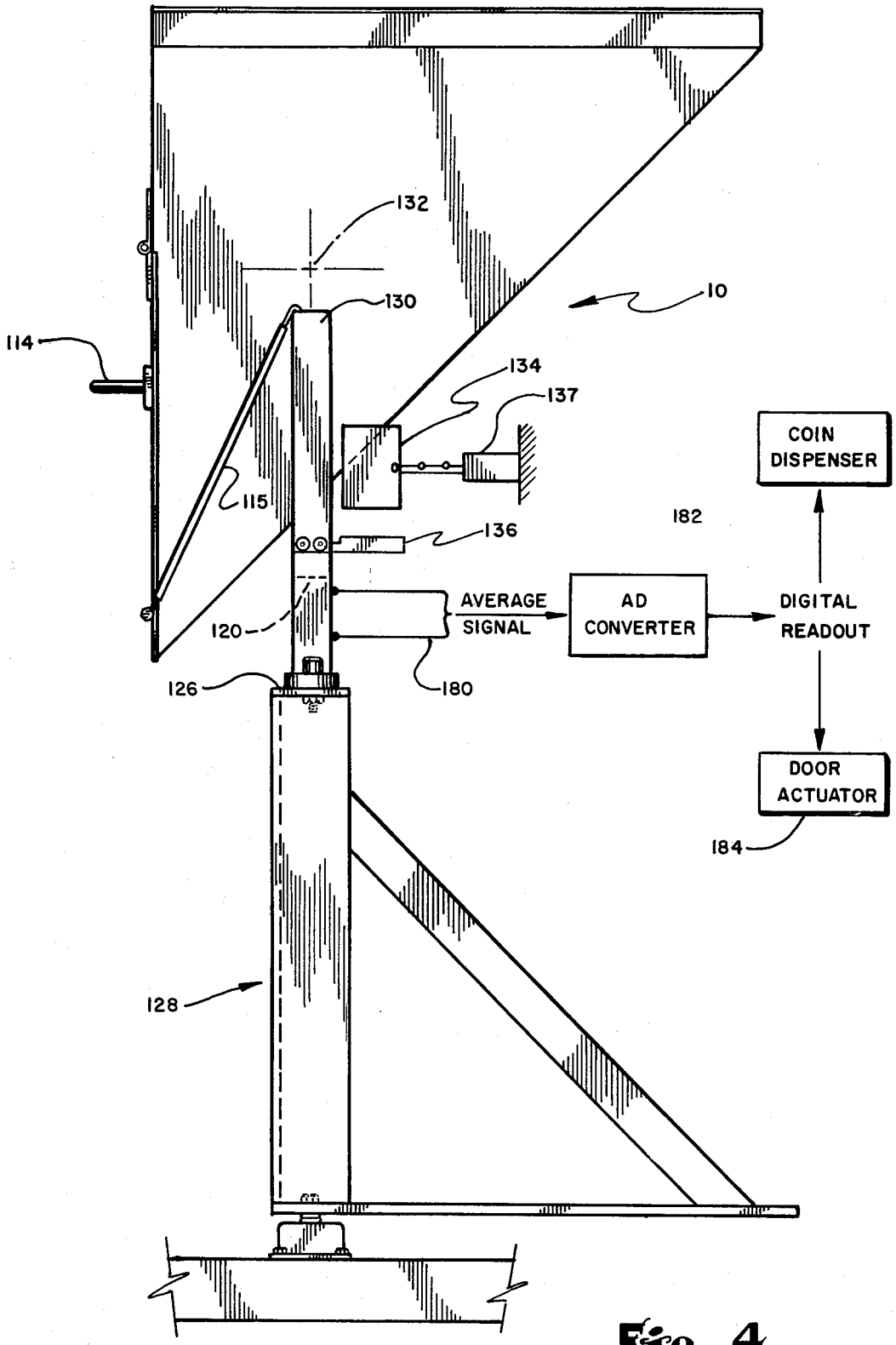
FIG. 4 is an enlarged side elevational view of a weigh hopper used with the apparatus of FIG. 1.
Figure 5:
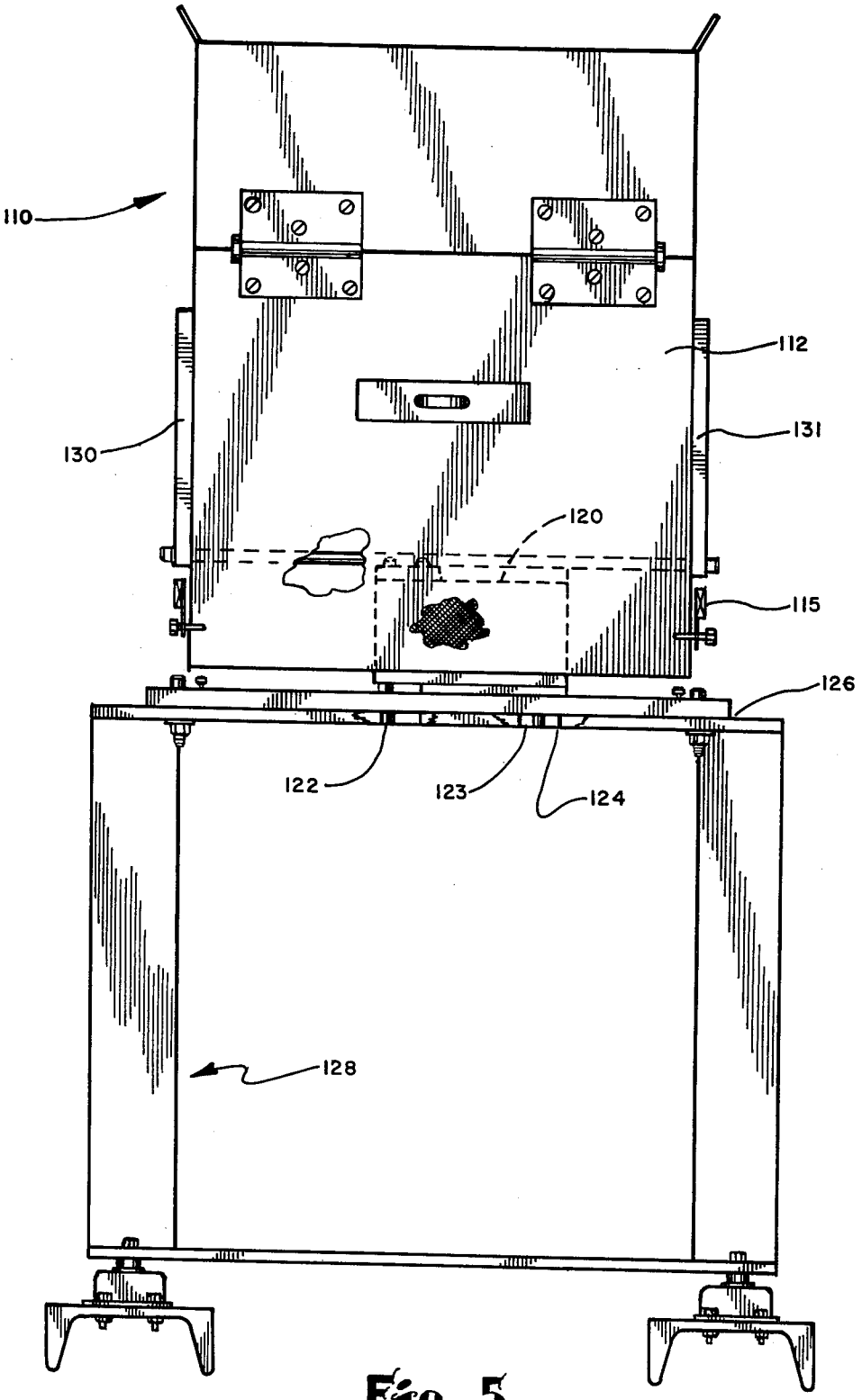
FIG. 5 is an end view of the weigh hopper of FIG. 4.

A weigh hopper means 110 is located below hopper means 103 for receiving and holding crushed aluminum cans 32A falling by gravity from hopper means 103. A selectively operable pivotally mounted door means 112, operable by a linear actuator means 114 against a compression spring means 115, FIG. 4, enables the cans to be dumped by gravity into an unloader means 116 to be hereinafter described. As shown in FIGS. 4 & 5, hopper 103 is mounted on and fully supported by a load cell means 120, having adjustment bolts 122, 123, 124 mounted in a support plate 126 of a support stand means 128, and located between guide plate means 130, 131 approximately in line with the center of gravity 132 of the hopper 100. In order to selectively calibrate the weigh system, a standard load member 134 is mounted above a load plate 136 and movable by a solenoid actuated device 137 between a retracted position, spaced from the load plate, to an extended position in engagement with and fully supported by the load plate and the load cell whereby any changes in the specific gravity of the hopper or ambient conditions affecting the load cell may be taken into account in the control circuity to continuously adjust the weight measurements.

The unloading means 102, 116, FIG. 3, comprise ducts 40, 142 of circular cross-section selectively connectable to a low pressure high volume blower 144 through a branch duct 146 having a control door 148 movable, between a first position connecting blower 144 to duct 140 and a second position connecting blower 144 to duct 142, by suitable control mechanism 150. Each of ducts 140, 142 is connected to an hopper-discharge duct 152, 154 having inlet portions 156, 158, FIG. 2, with upwardly facing inlet openings 160, 162, FIG. 3, for receiving crushed aluminum and steel cans, respectively, and discharge openings 164, 166, FIG. 1B, connectable to a flexible conduit member (not shown) for transfer of crushed cans from the machine to a truck or separate storage container (not shown).

The blower means 70, 164 are selectively driven by electric motors 170, 171 mounted on the housing floor and pulley-belt apparatus 172, 173, FIG. 3. Conveyor means 46 is selectively driven by an electric motor 174 and pulley-belt apparatus 175, FIG. 1B, mounted on the upper end portion of the conveyor means. Crusher means 80 is operated by an electric motor 176 and mechanical eccentric linkage means 177 mounted on a support frame means 178, FIG. 2, on which the hoppers and operating mechanisms for the hopper doors are also mounted.

In operation, used cans are placed in the inlet hopper 36, FIG. 1A, through inlet opening means 30 and fall by gravity through opening 40 into accumulator chute means 38 which enables the cans to be loosely supported therewithin with lowermost cans being located between side plates 50, 51 for gravity movement onto the lower end of belt conveyor 49. The lowermost cans fill the spaces between the rib members 48 as the belt 49 moves upwardly and are transported to the upper end of belt conveyor 49, FIG. 1B, where they are normally separately sequentially discharged due to the incline of the ribs into chamber 58 by gravity and centrifugal force so as to fall into a pressurized air stream being discharged from duct 72 which forces empty aluminum and steel cans 32E across chamber 58 to discharge opening 66. Heavy objects 32F fall through the air stream and opening 65 which is connected to suitable hopper means (not shown) by suitable chute means (not shown). Aluminum and steel cans 32E fall by gravity from opening 66 into crusher means 80, FIGS. 1B & 2, whereat the cans are crushed. Crushed cans 32C fall by gravity onto conveyor belt separator means 92. As belt 95 moves around magnetic sprocket 96, crushed aluminum cans 32A are discharged into aluminum can accumulator hopper means 103 by gravity and centrifugal force while crushed steel cans 32S are carried around sprocket 96 by magnetic force and then discharged into steel can accumulator hopper means 98 through chute means 97 by momentum and gravitational force.

At the beginning of a container return cycle, which may be initiated manually by a customer by pushing a start button, aluminum accumulator hopper door 104, FIG. 2, is in the open position so that a predetermined amount of crushed aluminum cans 32A fall directly into weigh hopper means 110 through the accumulator hopper 103. When the weigh hopper 110 has a predetermined maximum weight of cans, a signal is generated to cause the accumulator hopper door 104 to be closed whereby additional aluminum cans are stored in the accumulator hopper 103 until completion of a weighing cycle for the cans in the weigh hopper 110. During a weigh cycle of approximately 10 seconds, a multiple sample weighing procedure may be followed whereby multiple weight signals 180, FIG. 4, are generated and averaged in an AD converter 182 to obtain an accurate representative weight from the aluminum cans in the weigh hopper 110. To further assure accurate weighing and dispensing of proper amounts of compensation for each customer, the standard weight means 134 may be periodically applied to the load cell to recalibrate the weigh circuit. When a weigh cycle is completed, the hopper door 112 is opened by a signal sent to the door actuator 184 and the weighed aluminum cans are dropped by gravity into the unloader means 116, FIG. 2. Then door 112 is closed and accumulator hopper door 104 is opened to drop the next batch of cans to be weighed into the weigh hopper 110. The weight signal causes dispensing of the proper amount of compensation from a coin dispenser 34, FIG. 1A, after each weigh cycle. The present apparatus does not provide for weighing of steel cans because the apparatus is adapted to receive and pay only for aluminum cans which at the present time have the only profitable recycle value. However, a similar weigh system may be employed for the steel cans if economically feasible or desireable. The apparatus may be programmed to continue operation until all cans in the system have been processed. It is contemplated that a maximum of 200 cans may be processed within 60 to 90 seconds.

Whenever a predetermined amount of steel cans are accumulated in hopper 97, electronic sensing means 186, FIG. 2, provides a signal for causing temporary disablement of the aluminum weighing apparatus at the next opportune time, e.g., upon completion of an in process operational cycle, to enable automatic discharge of steel cans. This signal causes closing of the aluminum accumulator door 104, dumping of weigh hopper 110, repositioning of diverter valve 168, FIG. 3, dumping of steel can accumulator 98, FIG. 2, and then return to the initial positions without interrupting the flow of cans being recycled within the machine. In this manner, the operation of the machine may be continuous. All of the control devices, actuator devices, sensing devices, electric circuits, etc. are of conventional design and may be arranged and connected in a conventional manner to provide the desired results.

Second Embodiment

Referring now to FIGS. 6–13, a second embodiment of the invention comprises a housing means 200 including a relatively small can processing module 201 of generally rectangular cross-sectional configuration which may be removably attached to a relatively large can storage module 202 of generally square-shape cross-sectional configuration along a partition wall 203 therebetween. Each module has a bottom wall 204, 205, a top wall 206, 207, and side walls 208, 209, 210 & 211, 212, 213 mounted on suitable frame members. An inlet means 214 in a side wall is provided to receive used cans 215 and a compensation dispensing means 216 on the side wall adjacent to the inlet means dispenses compensation to a customer. A can receiving hopper-chute means 218 is connected to inlet means 212 for temporarily receiving and for enabling free gravity fall of cans into a hopper means 220 having a downwardly inwardly inclined wall 222 mounted above an upwardly inclined continuous belt-type conveyor means 226 of the type previously described having the upper belt portion 227 located within the open bottom portion of the hopper means 220 so that the cans are located at the bottom portion of the hopper means 220 and conveyor means 226 and are carried upwardly on the belt portion 227 by rib members 228 and around upper sprocket wheel 229 for discharge into an inlet opening 230 in an upwardly inclined can conveying duct means 232. A low pressure high volume air blower means 234 is connected to the lower end portion of duct means 232 for providing a flow of air therein to move empty relatively light aluminum and steel cans upwardly in the duct means to a discharge opening 236 while permitting relatively heavy articles, such as bottles or filled cans, to fall through the air flow to a discharge opening 238 into a storage bin means 240.

Figure 6:
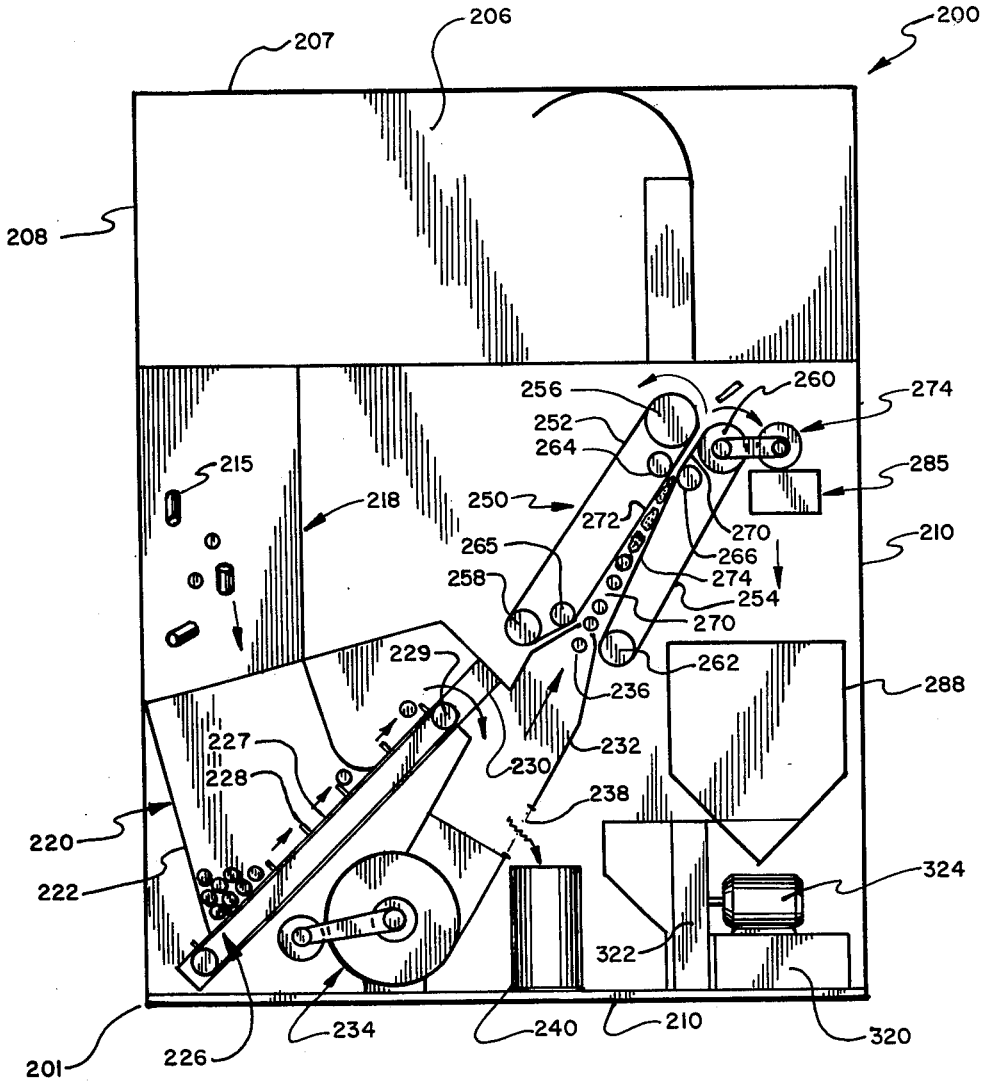
FIG. 6 is a schematic end view of a second embodiment of the invention.
Figure 9:
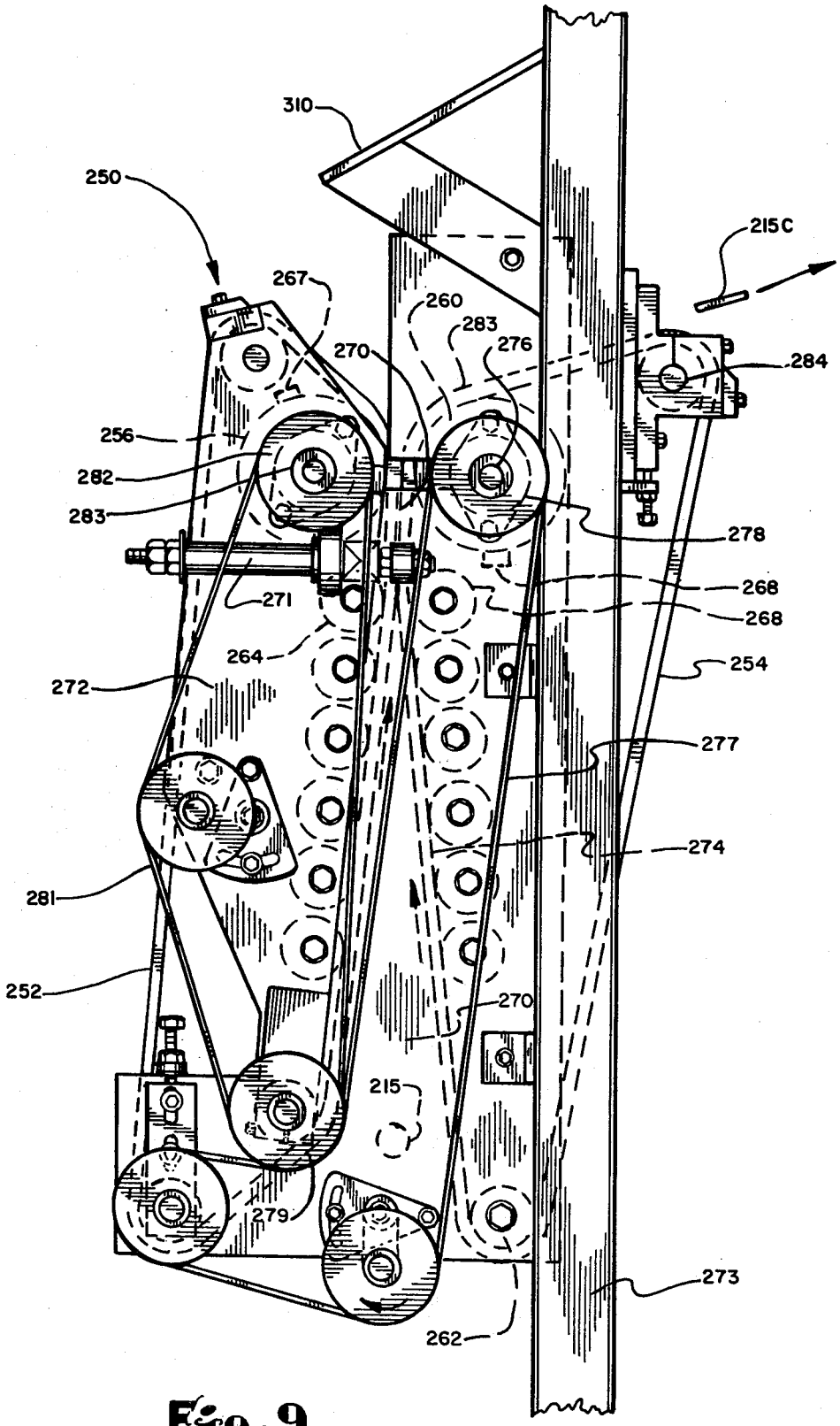
FIG. 9 is an enlarged side elevational view of crusher apparatus associated with the embodiment of FIGS. 6–8.
Figure 10:
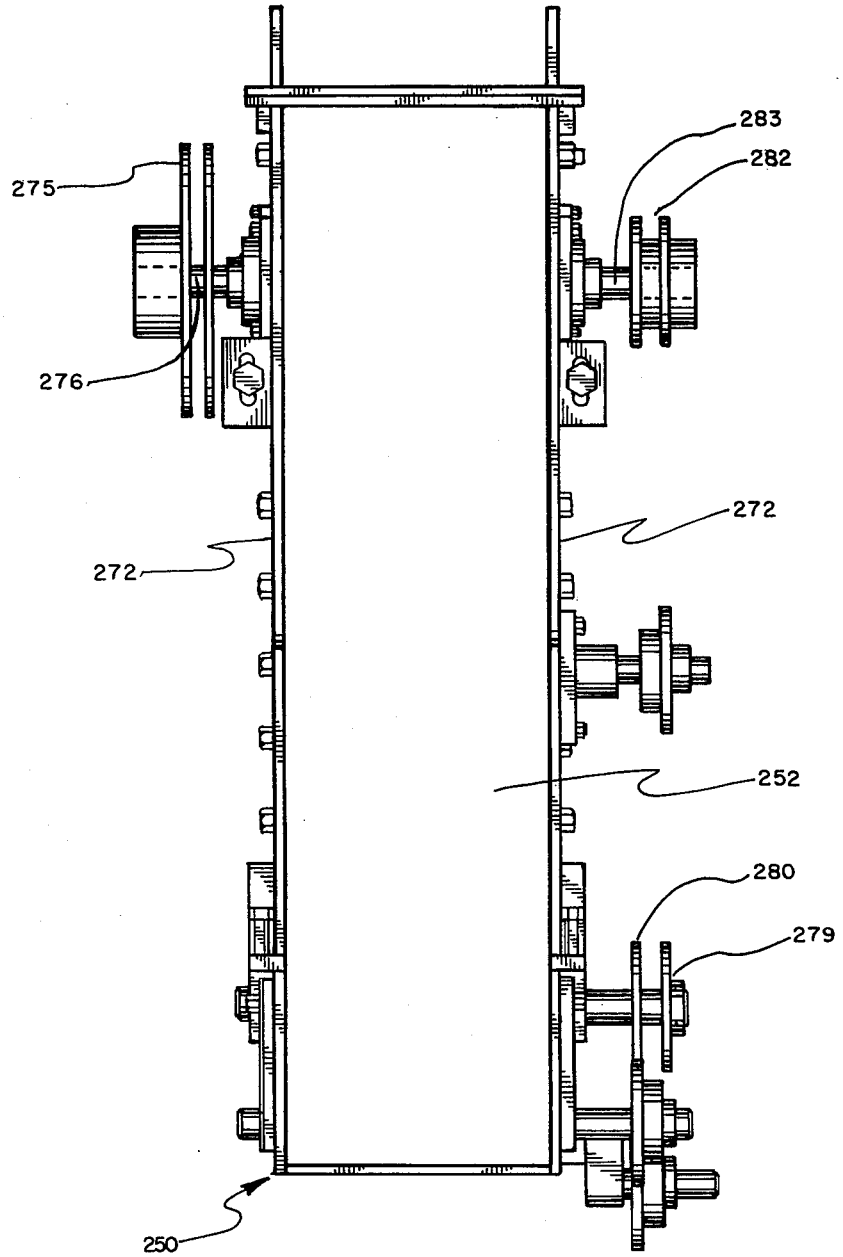
FIG. 10 is a side view of a portion of the crusher apparatus of FIG. 9.
Figure 12:
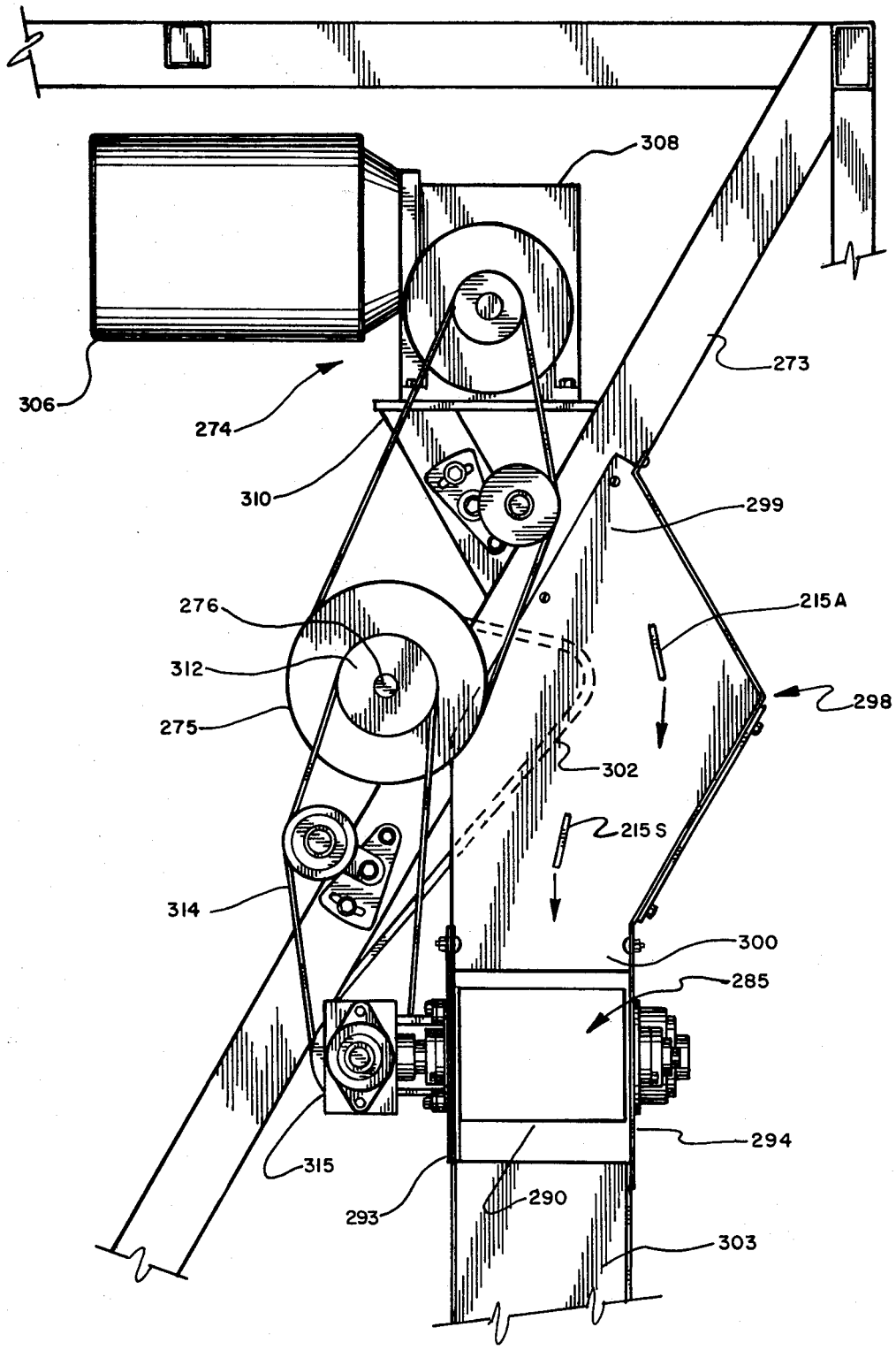
FIG. 12 is a side view of the apparatus of FIG. 11.

A crusher means 250 is located above and connected to discharge opening 236 of duct means 232 for crushing both empty aluminum and steel cans. The crusher means 250 comprises a pair of continuous flat wire belt-type members 252, 254 mounted on suitable end sprocket cylinder members 256, 258, and 260, 262, respectively, and sufficient intermediate guide and support sprockets 264, 266, 266, etc. Belt and sprocket apparatus of this type is described in U.S. Pat. No. 3,578,139, the disclosure of which is incorporated herein by reference. As shown in FIGS. 9 & 10, the belt type members 252, 254 are made of a multiplicity of U-shape steel alloy open links, which are harder and stronger than the relatively light weight thin wall cans to be crushed thereby, and are of conventional commercially available design such as manufactured and sold by the Alloy Wire Belt Company, 210 Phelan Avenue, San Jose, Calif. Sprocket cylinder members 256, 258, 260, 262 have a plurality of circumferentially spaced teeth 267, 268, FIG. 9, which mesh with the open links of the belt members as described in U.S. Pat. No. 3,578,139. The construction and arrangement of the belt members 252, 254, is such as to define an upwardly inclined crushing slot 270 of gradually decreasing width between relatively inclined upwardly moving adjacent portions 272, 274 of each belt member. The cans are blown into and upwardly along crushing slot 270 through opening 236 by air flow with assistance of the forces applied to the cans by upward movement of belt portions 272, 274. The adjacent uppermost portions of belt members 252, 254 are mounted in closely spaced parallel relationship by sprocket cylinders 256, 258 and guide sprockets 264, 268 to define an elongated final crushing area 270 therebetween whereat the cans are finally flattened to a desired condition suitable for subsequent recycling operations. The spacing of the belt members 252, 254 in the crushing area may be controlled by adjustable spring means 271, FIG. 9, to control the density of the crushed cans. As the cans pass between sprocket cylinders 256, 258, the teeth within the open links provide a substantially continuous crushing surface. The belts 252, 254 are mounted between spaced plate members 272, FIG. 10, fixed to frame members 273, which are mounted in an upwardly inclined position as shown in FIGS. 6 & 12 (FIG. 9 does not show the inclined mounting position). Sprocket cylinder 260 and belt 254 are driven by an electric motor and chain drive 274, FIG. 6, connected to a sprocket 275, FIG. 10, mounted on a shaft 276. Sprocket cylinder 256 and belt 252 are driven by a chain 277, FIG. 9, connected to a sprocket wheel 278 on shaft 276 and a sprocket wheel 279 which drives a sprocket wheel 280 and chain 281, FIG. 9, connected to a sprocket wheel 282 mounted on shaft 283 of sprocket cylinder 256.

Figure 7:
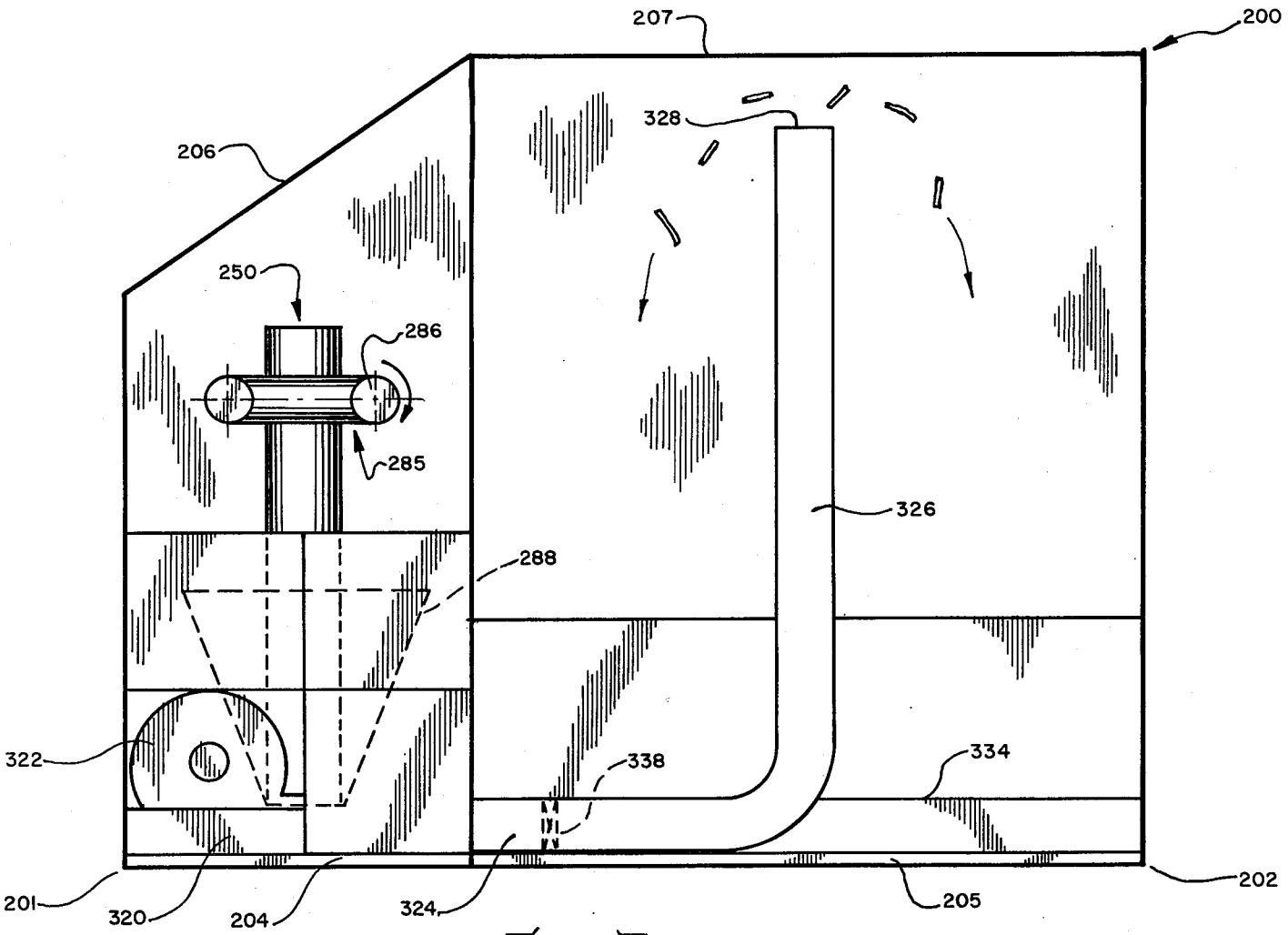
FIG. 7 is a schematic side view of the apparatus of FIG. 6.
Figure 8:
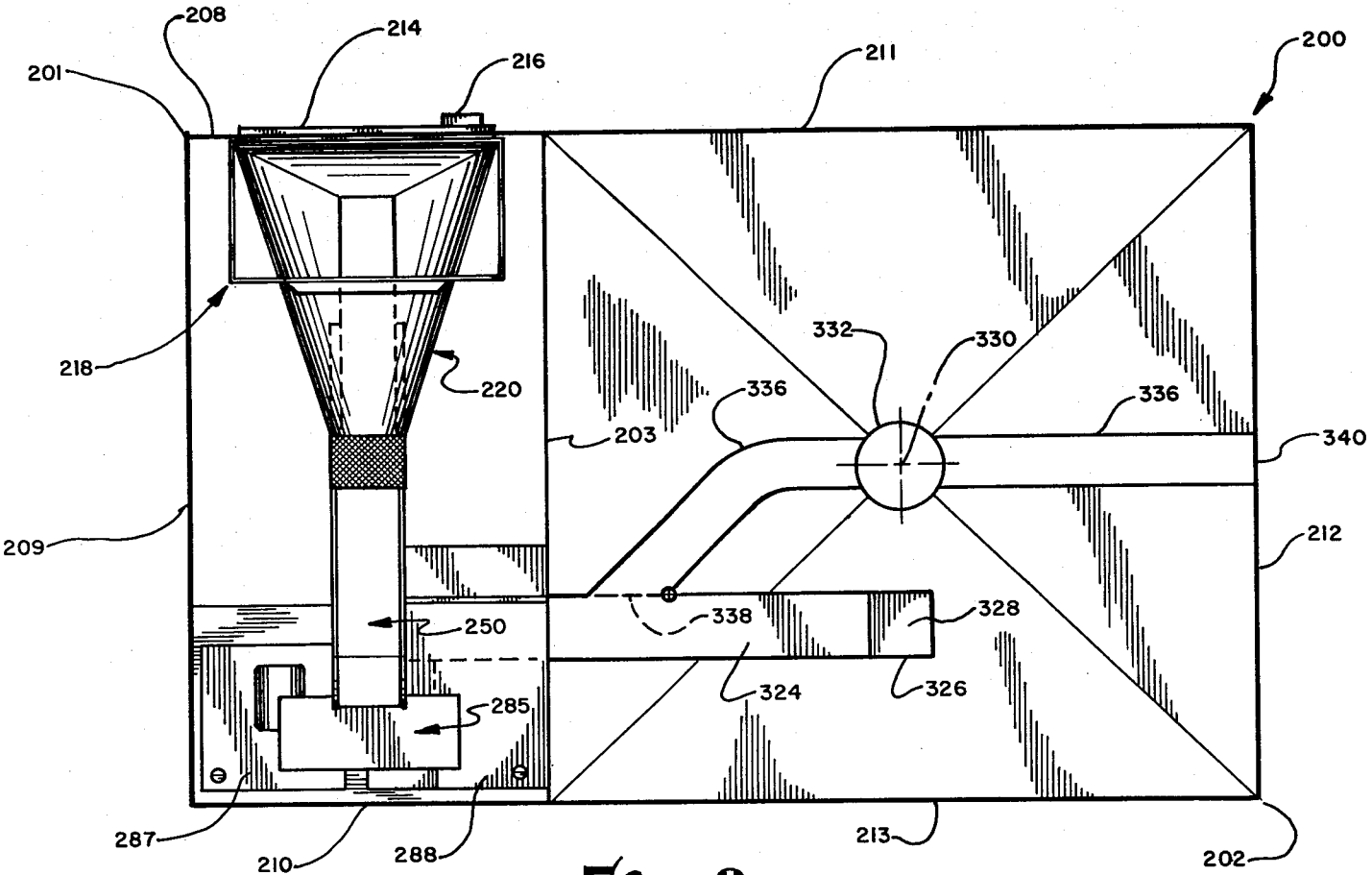
FIG. 8 is a schematic plan view of the apparatus of FIG. 6.
Figure 13:
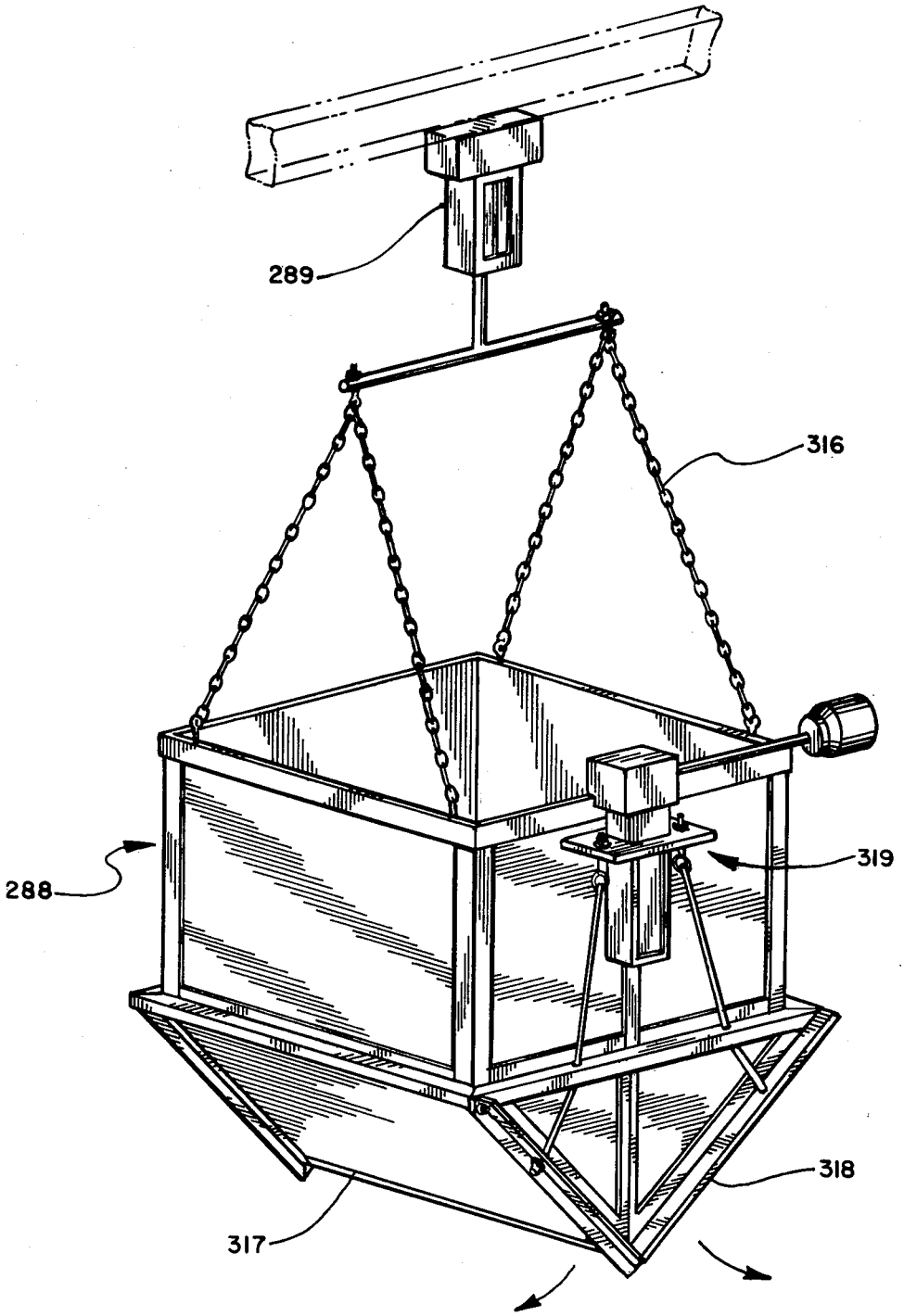
FIG. 13 is an enlarged perspective view of a weigh apparatus associated with the embodiment of FIGS. 6–8.

The crushed cans 215C are carried by belt 254 around end sprocket 260 by a laterally extending belt portion 283 FIG. 9, and discharged as belt portion 283 moves about sprocket 284 by momentum and gravity fall onto a transversely extending continuous belt-type conveyor separator means 285, FIG. 7, located therebelow which has a magnetic end pulley 286 for effecting separation of crushed aluminum and steel cans by carrying steel cans around the end pulley for gravity-momentum fall into a steel storage hopper means 287, FIG. 8, while aluminum cans are discharged as the belt turns about the pulley for gravity-momentum fall into an aluminum weigh hopper means 288 suspended from a load cell 289, FIG. 13.

Figure 11:
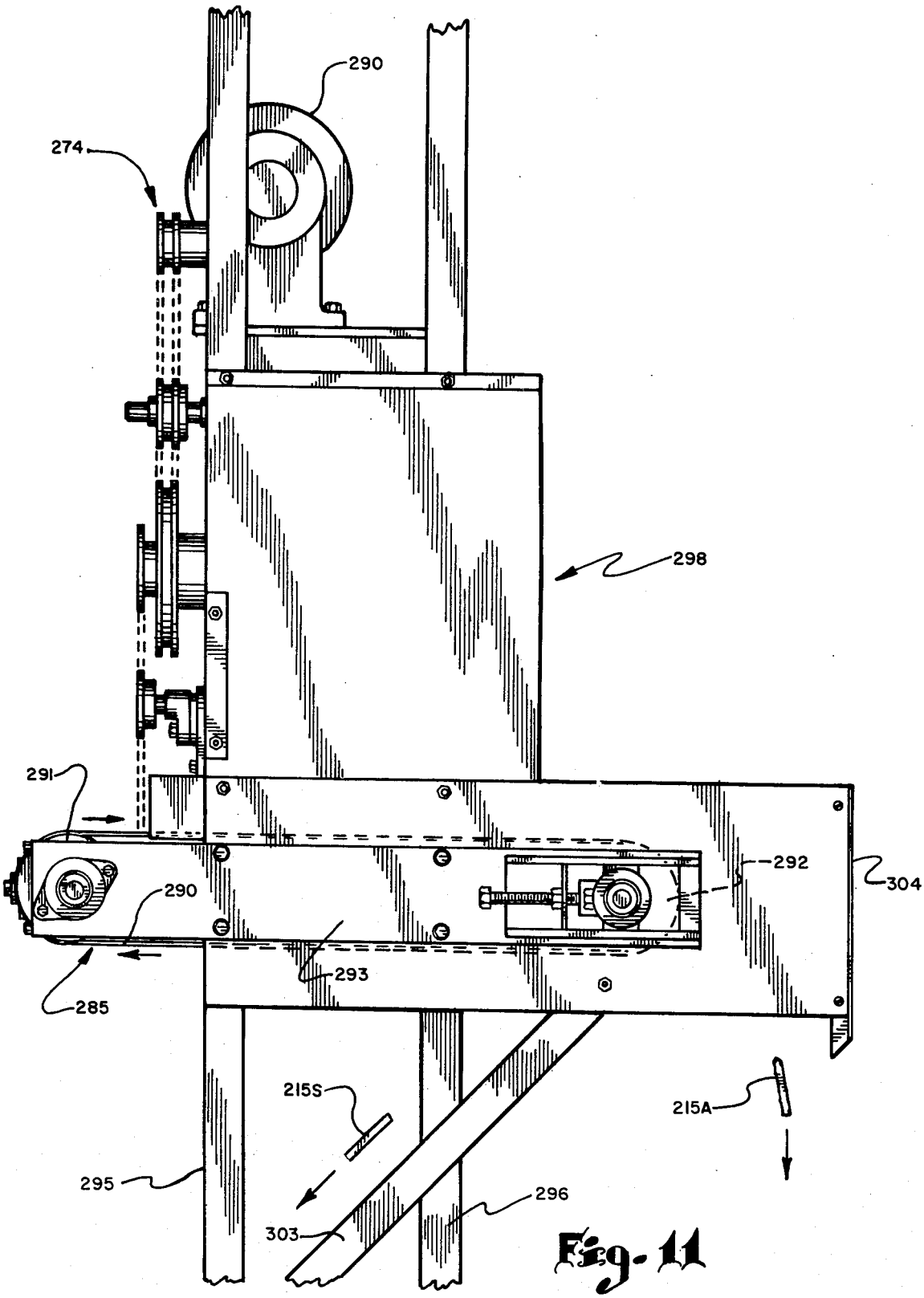
FIG. 11 is an enlarged side elevational view of a magnetic gravity type separator conveyor apparatus associated with the embodiment of FIGS. 6–8.

As shown in FIGS. 11 & 12, conveyor separator means 285 comprises an endless belt member 290 mounted on rollers 291, 292 supported between spaced side plate members 293, 294 mounted on frame members 295, 296. A chute means 298, having an upper inlet opening 299 for receiving crushed aluminum and steel cans 215A & 215S from the crusher means 250 and a lower outlet opening 300 for discharging crushed cans onto belt 290, is mounted above belt 290 on frame members 301. A guide plate means 302 extends into chute means 298 to guide the crushed cans inwardly and downwardly away from the crusher means. Roller 292 is magnetic so that crushed steel cans 215S are carried around the roller 292 and discharged above a chute means 303 for movement to the steel can storage bin 287, FIG. 8, while crushed aluminum cans are discharged at the roller 292 toward end plate 304, FIG. 11, for downward movement to aluminum can weigh hopper 288, FIG. 8. Both the crusher means 250, FIG. 9, and the conveyor separator means 285, FIG. 12, are driven by a single electric motor 306 and gear box 308 mounted on a bracket 310 fixed to frame members 273, 301. A sprocket wheel 312, driveably connected to shaft 276, drives a chain 314 associated with a conveyor drive mechanism 315.

Aluminum hopper means 288, FIGS. 6 & 7, is suspended from the load cell 289 on chains 316 above unloader duct means 320 which is connected to air blower means 322 driven by an electric motor 324. Movable doors 317, 318 (FIG. 13) at the bottom of hopper means 288 are selectively actuated by a motorized linkage system 319 to discharge crushed cans into duct means 320 which is connected to a horizontal duct 325, FIG. 7, at the bottom of the relatively large (e.g., 420 c.f., 2100 pound) aluminum can storage bin means 202. The volume of storage bin module 202 may be at least 50% greater than the total volume of the space within the process module 201. Horizontal duct 325 is connected to an upwardly extending vertical duct 326 having a discharge opening 328 at the upper end thereof and located in outwardly offset relationship to the central vertical axis 330, FIG. 8, of bin means 200 for a purpose to be hereinafter described. In this manner, after the weigh cycle, crushed aluminum cans are dumped from weigh hopper 288 into duct 320 and blown along ducts 320, 324 and upwardly through duct 326 for discharge through opening 328 at the top of storage bin 200 and free gravity fall therewithin. In order to unload storage bin 200, a selectively openable discharge opening 332 is provided in the bottom bin wall 334 to enable crushed cans to fall into an unloading duct 336 selectively connectible at one end to blower means 322 through a portion of duct means 324 by suitable valve means 338. A discharge opening 340 at the end of duct 336 is connectible to a flexible conduit or the like to load crushed cans into a vehicle such as a truck or trailer. Steel cans may be periodically removed from the steel can storage hopper means 287 through a side door or panel in the housing because of the relatively low volume of steel cans.

Third Embodiment

Figure 14:
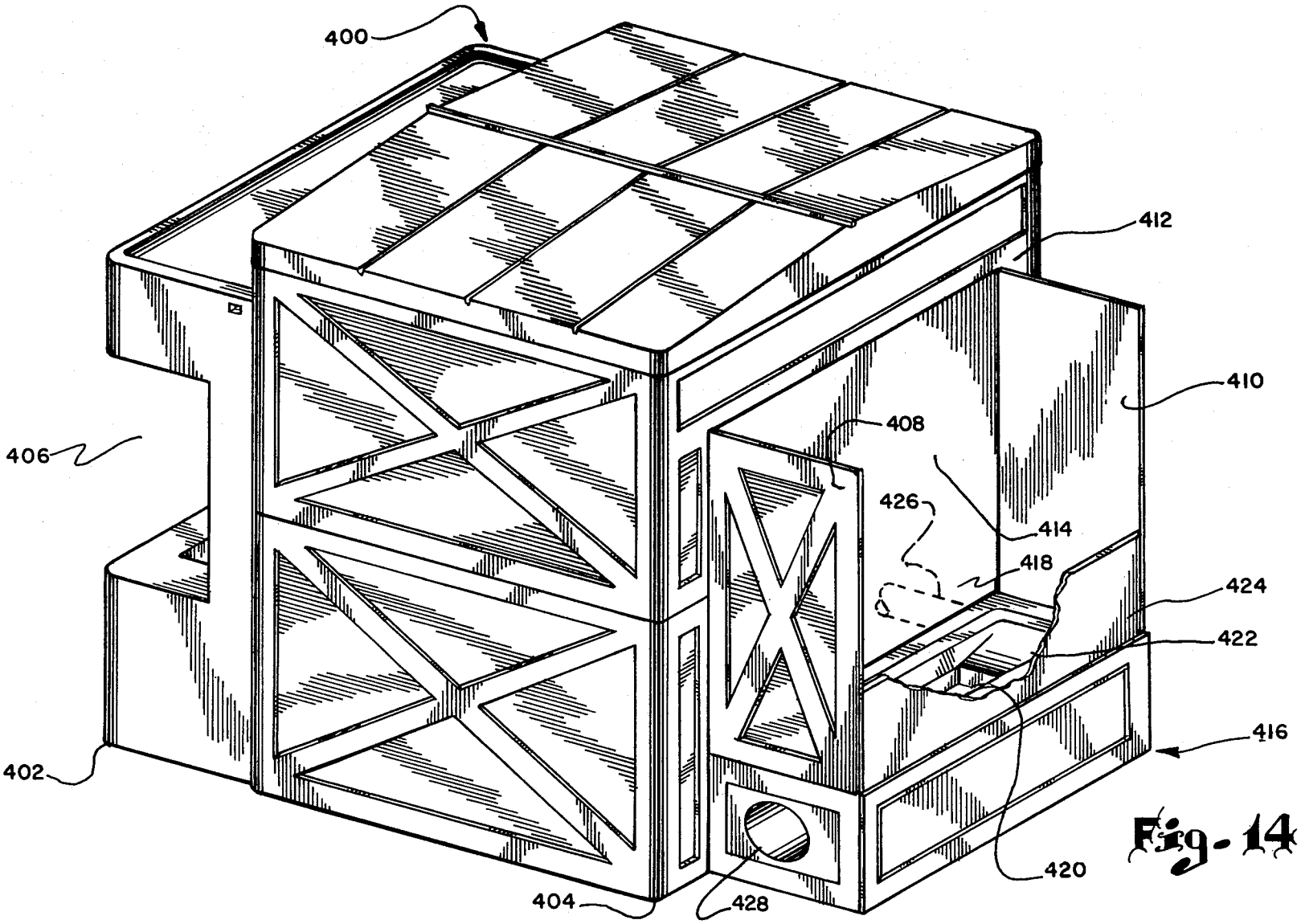
FIG. 14 is a perspective view of a third embodiment of the invention.

Referring to FIGS. 14–27, a third embodiment of the invention comprises a housing unit 400 including a relatively small size can processing module 402 which may be separately constructed and removably attached to a relatively large size storage bin module 404. Can processing module 402 has a rectangular configuration with an inlet opening means 406 in one corner thereof. Storage bin module 404 is of square shape configuration with a pair of doors 408, 410 on end wall 412 to provide access to storage chamber 414. A container unloading means 416, in the form of a rectangular box shape device, is slidably movable between a retracted stowed position (not shown) located beneath the bottom wall 418 of chamber 414 and an extended unloading position (FIGS. 14 & 18) whereat crushed cans in chamber 414 may be pushed into an air duct in container unloading means 416 through a duct opening 420 in a downwardly inwardly inclined recessed upper wall portion 422. A lid member 424 may be pivotally mounted on the outer edge of the container unloading means for pivotal movement between a horizontal position (not shown) covering the top wall portion 422 and a vertical position (FIG. 14) to provide a retaining means when crushed cans are being unloaded from chamber 414. One end of the air duct in unloading means 416 is connected to a conventional flexible air conduit 426, which extends under bottom wall 418, and the other end has an outlet opening 428 which is connectable to another flexible air conduit 429, FIG. 18, to transport crushed cans to a can collection truck or the like.

Figure 15:
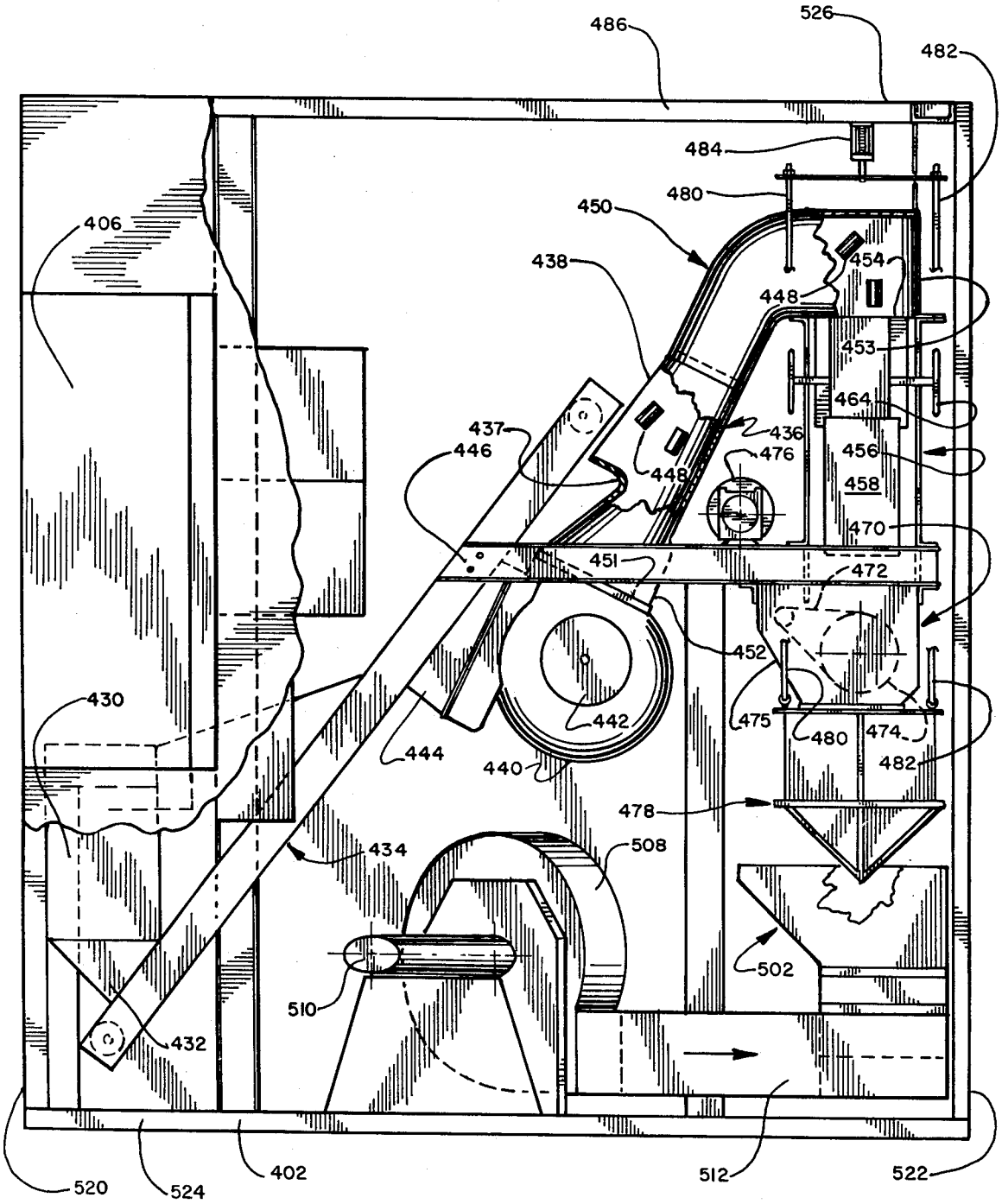
FIG. 15 is a side elevational view, with parts removed, of the embodiment of FIG. 14.
Figure 16:
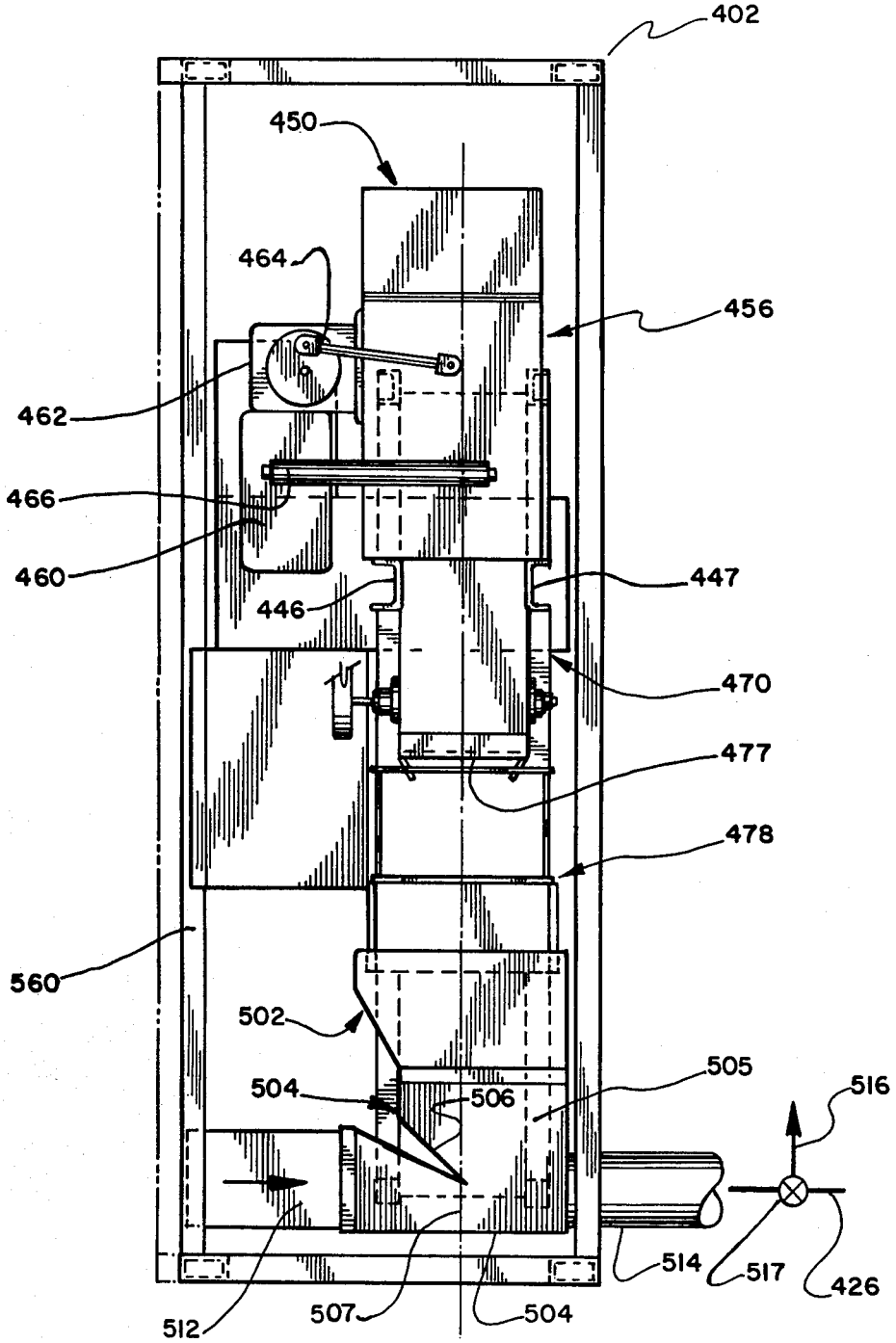
FIG. 16 is an end view of a portion of the embodiment of FIG. 14.
Figure 17:
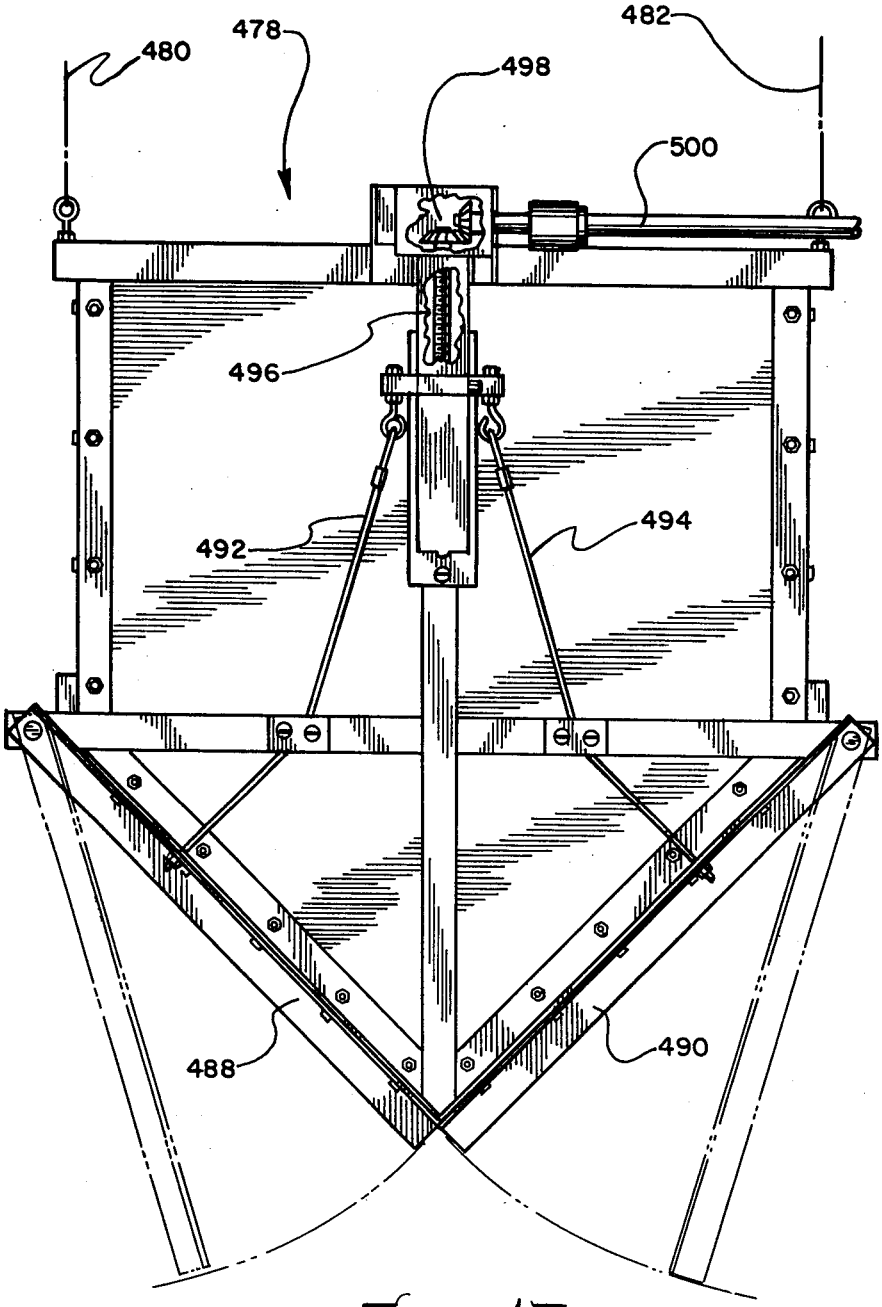
FIG. 17 is an enlarged side elevational view of weigh apparatus associated with the embodiment of FIG. 14.
Figure 18:
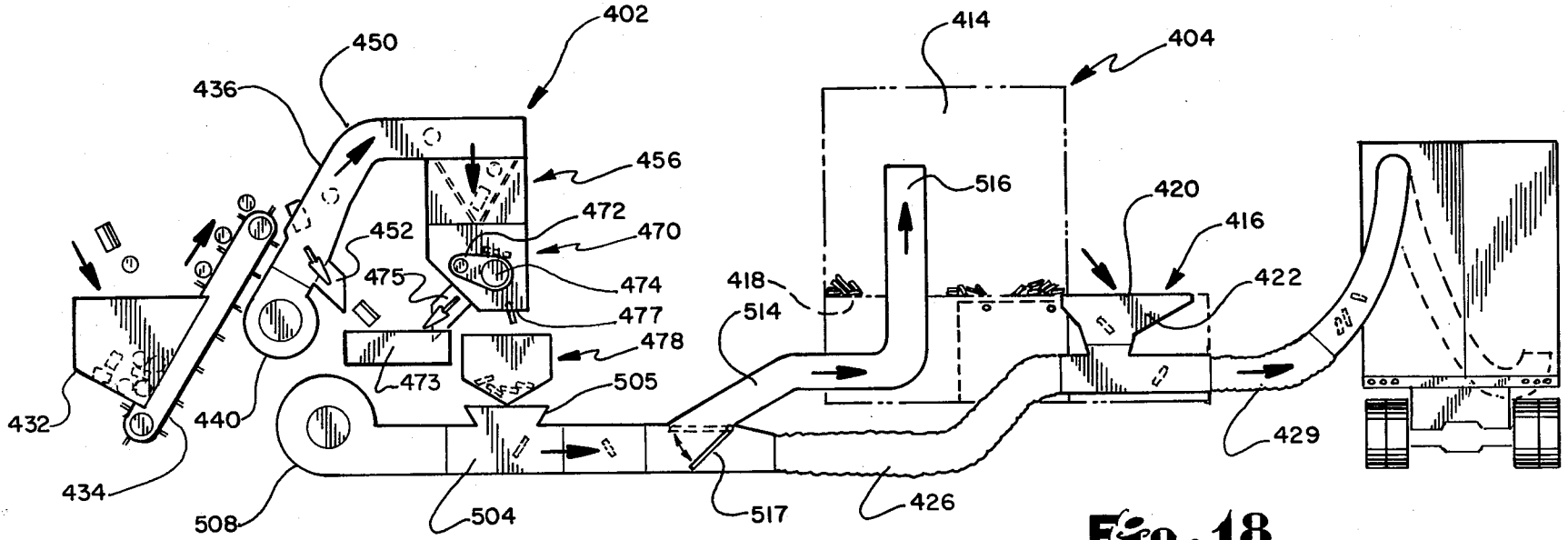
FIG. 18 is an exploded schematic view of a presently preferred embodiment of the invention.

The article processing module 402, FIGS. 15, 16 & 18, contains an inlet chute means 430 and a hopper means 432 associated with an upwardly inclined conveyor belt means 434 as previously described. All articles received in hopper means 432 are carried upwardly by belt means 434 and discharged into an air duct means 436, having a venturi-like section 437, through a relatively large opening 438. An air blower means 440, driven by an electric motor 442, is mounted on frame means 444, 446, 447 adjacent the upper end portion of conveyor belt means 434 and connected to air duct means 436 to provide an air stream to carry empty aluminum and steel containers 448 upwardly into an elbow shape duct means 450 while heavier objects fall by gravity onto a screen 451 and through a discharge opening 452. Air may be discharged through a screen means 453 at the end of duct means 450 and empty cans are discharged downwardly through a discharge opening 454 into a crusher means 456, as previously described, which is mounted on top of frame members 446, 447 and supports the upper portion of duct means 450. Crusher means 456 comprises a pivotally mounted crushing blade 458 operable by an electric motor 460, FIG. 16, through a gear box 462, an eccentric drive linkage means 464, and spring means 466 as previously described. A magnet conveyor belt type separator means 470, comprising an endless conveyor belt 472, FIG. 15, driven about a magnetic pulley 474 by an electric motor 476 mounted on frame members 446, 447, is mounted on the bottom of frame members 446, 447 for receiving crushed aluminum and steel cans from crusher means 456 and separating crushed aluminum cans from crushed steel cans as previously described with steel cans being discharged to a storage bin 473, FIG. 18, through a discharge opening 475. Crushed aluminum cans are discharged from separator means 470 through bottom discharge opening 477, FIG. 16, into weigh hopper means 478 suitably suspended, such as by four wire support members 480, 482, FIG. 15, from a load cell means 484 attached to an upper frame member 486. A pair of pivotally mounted doors 488, 490, FIG. 17, controlled by wires 492, 494, a jack screw device 496, bevel gears 498, and a shaft 500 driven by an electric stepping motor (not shown), are selectively movable between open and closed positions to discharge crushed aluminum cans into chute means 502 connected to air duct inlet means 504 having an inlet hopper portion 505 with a downwardly inwardly inclined side wall 506 defining a venturi-like air passage section 507 upstream of inlet means 504 which enables air to flow into duct means 504. An air blower means 508 driven by an electric motor 510 is connected to duct means 504 by a duct section 512 to provide a source of pressurized air for transporting crushed aluminum cans through a horizontal duct 514 and a vertical duct 516 to storage chamber 414 as described in connection with FIGS. 7 & 8 of the second embodiment of the invention. Conduit 426 is selectably connectable to duct means 514 by a movable door means 517, as illustrated in FIGS. 16 & 18, to enable blower means 508 to be connected to duct box 416 when crushed aluminum cans are being unloaded from storage chamber 414 through duct box 416.

The construction and arrangement is such that cans being processed are transported: (1) longitudinally from a position closely adjacent one end wall 520, FIG. 15, to a position closely adjacent the opposite end wall 522 of process module 402; (2) vertically upwardly from a position closely adjacent the bottom wall 524 to an intermediate position closely adjacent upper wall 526 and end wall 522; and (3) vertically downwardly from a position closely adjacent the upper wall 526 to a position closely adjacent the bottom wall 524. Thus, the cans being processed are transported in substantially only one vertical plane extending longitudinally of the process module 402. All process apparatus is mounted in the process module 402 and all process apparatus, except the air blower 508, motor 510, and duct means 502–512, is mounted on frame means above floor portion 524. Duct means 436 and 450 are of relatively short length, e.g. approximately 2½ feet, so as to require a minimum volume and rate of flow of air to transport the empty cans to the crusher means 456. The vertical downward path of movement of the cans from discharge opening 454 to separator means 470 is closed by sheet metal panels which surround the crusher means 456 and three sides of separator means 470. Air blower 508 is centrally mounted in process module 402 with duct means 512 providing an air flow path extending longitudinally of the module alongside wall 560, FIG. 16, toward end wall 522 and duct means 504 providing an air flow path extending transversely of the module along end wall 522. Thus, the size of the process module may be advantageously reduced to approximately 10 feet high×2 feet wide×6½ feet long without loss of efficiency of operation or utilization of the desired process equipment and method of processing the containers.

Figure 19:
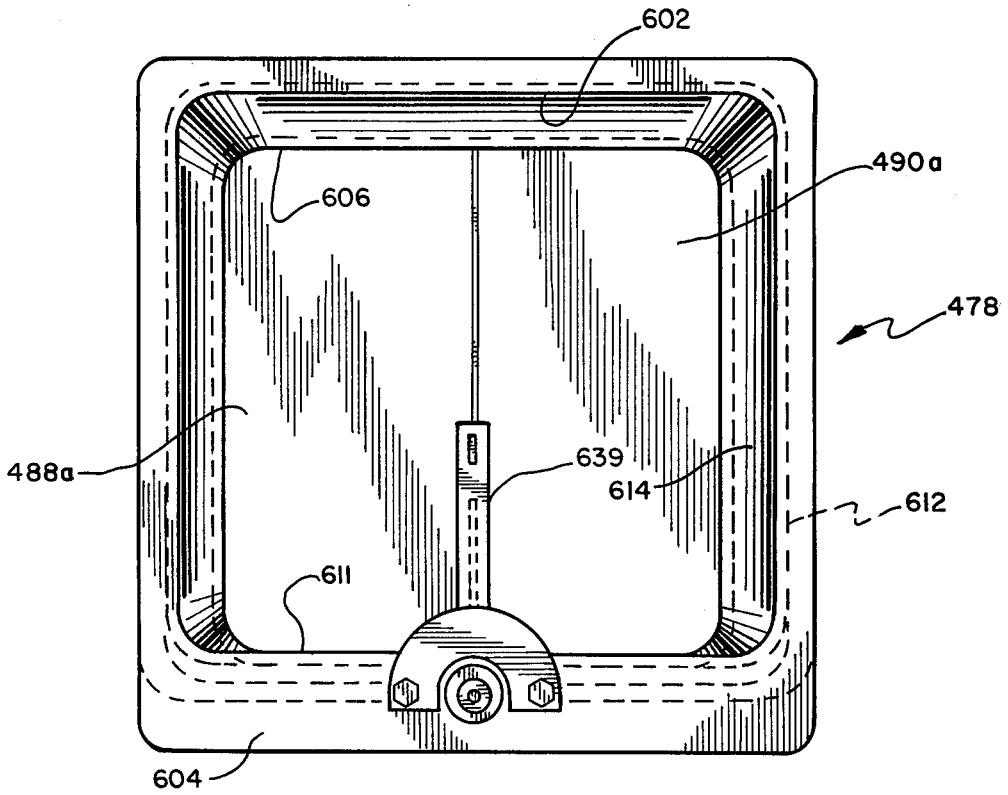
FIG. 19 is a plan view of a preferred embodiment of a weight hopper used with the apparatus of FIG. 18.
Figure 20:
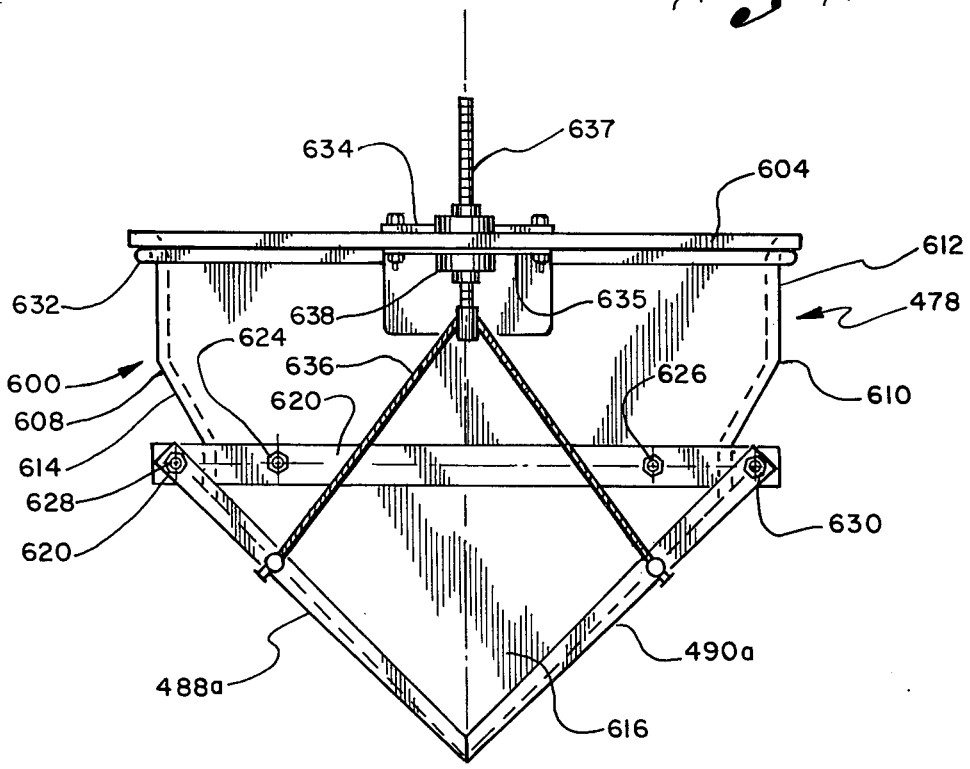
FIG. 20 is an end view of the apparatus of FIG. 19.
Figure 21:
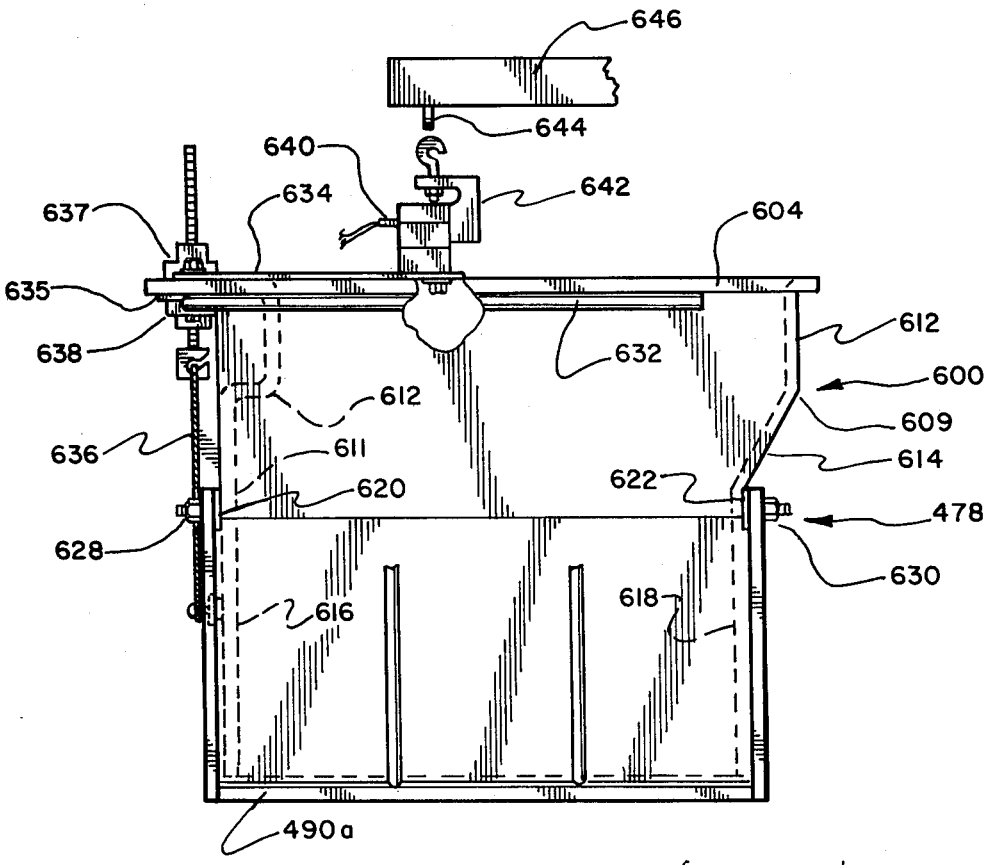
FIG. 21 is a side view of the apparatus of FIG. 20.

A presently preferred form of weigh hopper means 478, shown in FIGS. 19–21, comprises a hopper member 600 made of one piece of molded plastic material with an upper inlet opening 602 surrounded by a rim portion 604 and a lower outlet opening 606. The hopper side wall portions 608, 609, 610 have a vertical portion 612 and an inwardly inclined portion 614 while side wall portion 611 has an inwardly offset rib portion 612 above a straight downwardly extending portion 614. Side wall portions 609, 611 have triangularly shaped lower portions 616, 618. A pair of one piece plastic door assemblies **488*a* and 490*a* are pivotally mounted on metallic support bar members 620, 622, fastened to hopper side wall portions by bolt means 624, 626, by bolt means 628, 630 for pivotal movement between open and closed positions. An U-shape support bracket 632 is mounted under rim portion 604. Jack screw actuating means 496*a* are mounted on upper and lower support plate members 634, 635 on opposite sides of rim portion 604. Door means 488*a* & 490*a* are connected by a wire member 636 to a jack screw means 637 which is actuable by an electric stepping motor 638 as hereinafter described. Upper plate 634 has a rigid support arm portion 639, FIG. 19, extending inwardly over inlet opening 602. A load cell means 640 and a hook means 642, FIG. 21, are mounted on support arm portion 639 on the axis of the center of gravity of hopper means 478. Hook means 642 is connected to a support means 644, such as an eye bolt, fixedly mounted on a frame member 646** located closely adjacent (e.g., about one inch) the weigh hopper means.

Figure 22:
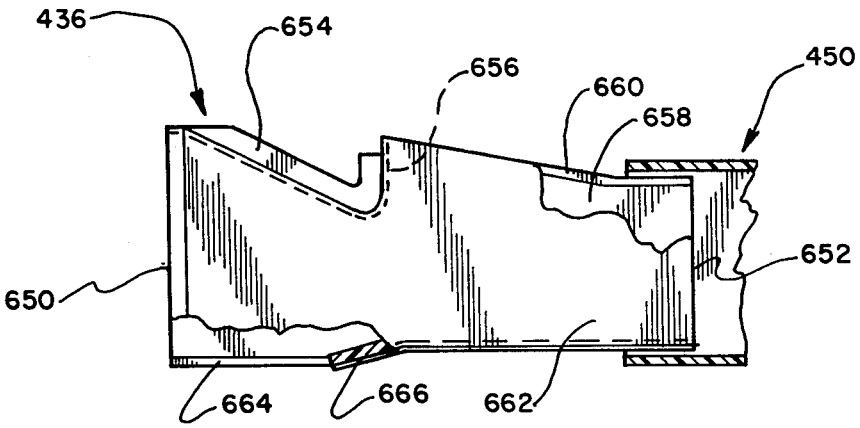
FIG. 22 is a side view of a preferred embodiment of a portion of the uncrushed can air conveyor passage of FIG. 18.

As shown in FIG. 22, the air duct means 436 & 450 may be made of one piece of molded plastic material. Duct means 436 has an air inlet opening 650 at one end and an air outlet opening 652 at the other end. The inlet end portion has a downwardly inwardly tapered upper wall portion 654 which terminates in an upwardly curved end portion 656 to provide a venturi section in the air passage. The outlet end portion has an elongated opening 658 extending between side wall portions 660, 662 for reception of articles from conveyor means 434. The inlet end portion has an opening 664 in the bottom wall portion 666 for discharging heavy articles.

Figure 25:
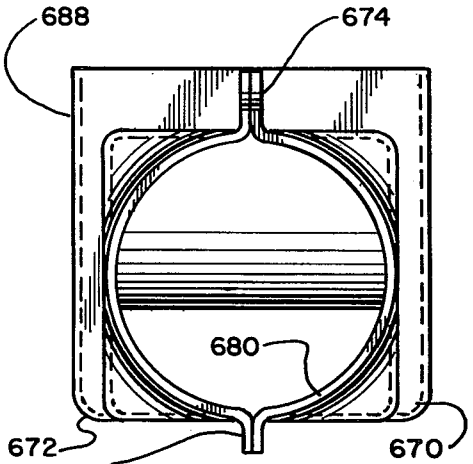
FIG. 25 is an end view of the apparatus of FIG. 23.
Figure 24:
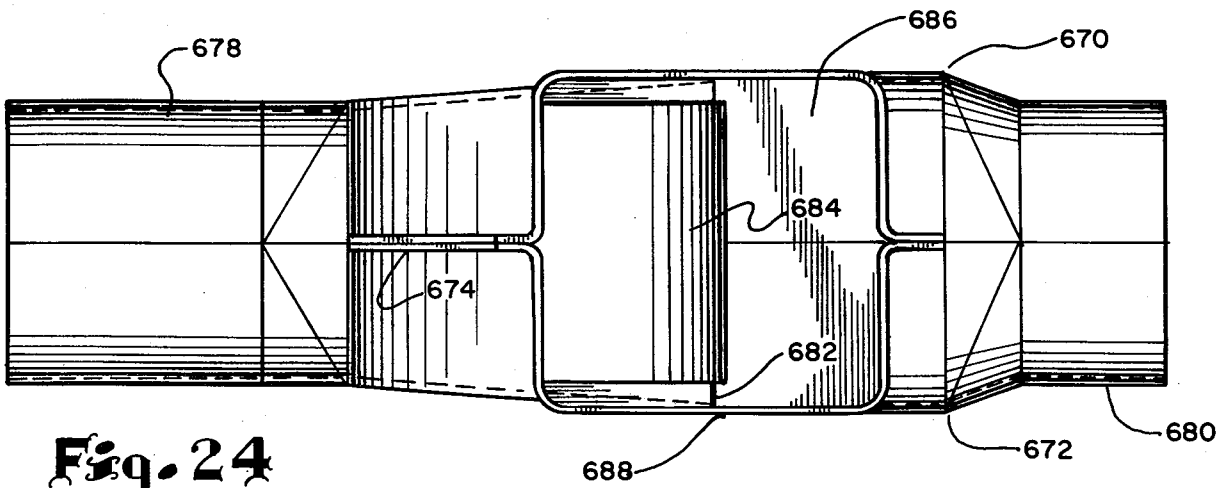
FIG. 24 is a top view of the apparatus of FIG. 23.
Figure 23:
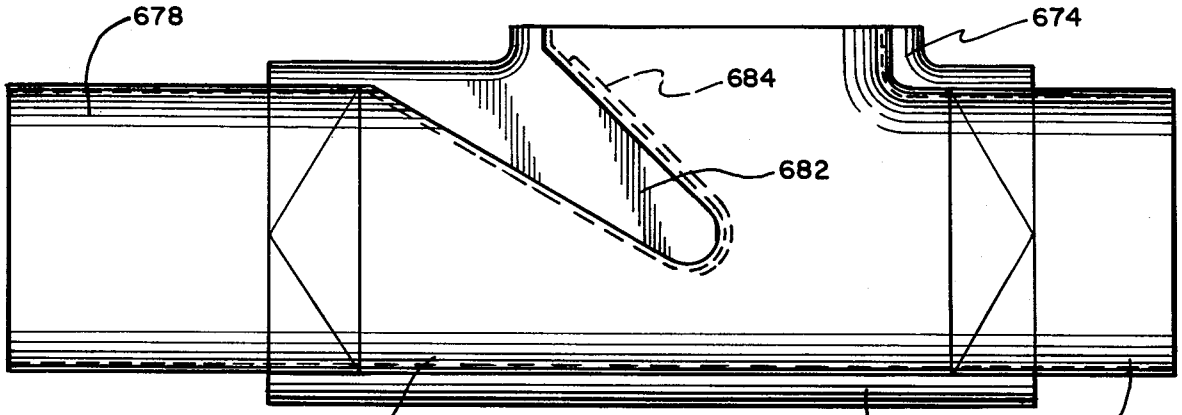
FIG. 23 is a side view of a preferred embodiment of a portion of the crushed can conveyor passage below the weigh hopper of FIG. 18.

As shown in FIGS. 23–25, duct-hopper means 504 may be made of two pieces 670, 672 of molded plastic material which are suitably fastened together through flange means 674, 676. Circular tubular connecting air inlet and outlet portions 678, 680 are provided at opposite ends of the duct-hopper means. A downwardly inwardly extending rib portion 682, having a wear plate 684 mounted thereon, provides a venturi section below a crushed can inlet opening 686 in an enlarged center portion 688 of the duct-hopper means which is of polygonal cross-sectional configuration. A sliding plate 689 may be provided for closing the inlet opening during unloading of the storage bin.

Figure 26:
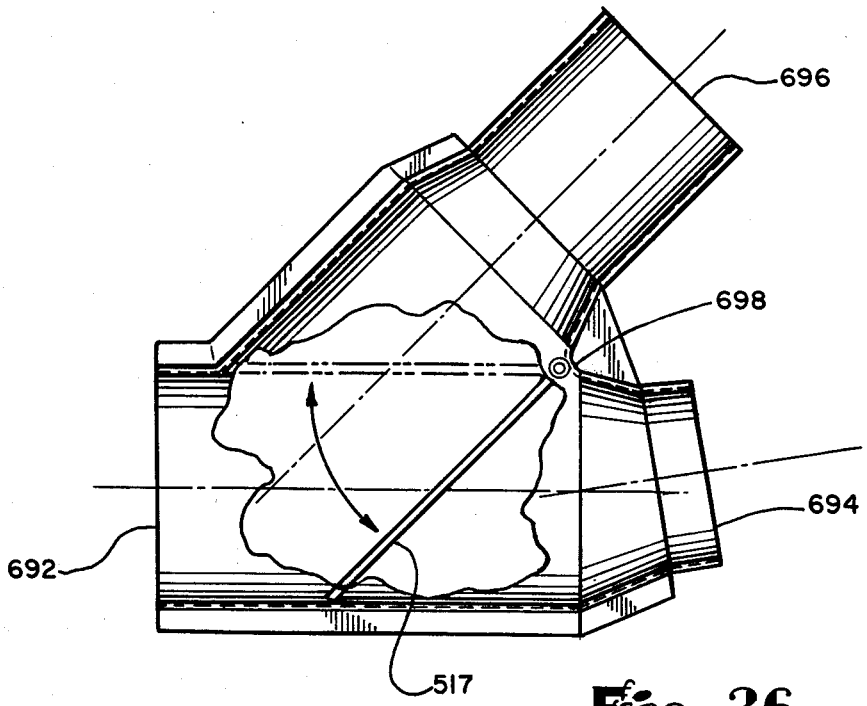
FIG. 26 is a top view of a preferred embodiment of the crushed can conveyor passage.

FIG. 26 shows a T-type connecting means 690 made of two pieces of molded plastic material which are suitably fastened together through flange means as previously described. An inlet opening 692 is provided at one end for connection to duct-hopper means 507. An outlet opening 694 of circular cross-section is provided at the other end for connection to conduit means 426. Another branch outlet opening 696 of circular cross-section is provided for connection to conduit means 514. Diverter valve means 517 is pivotally mounted at the junction 698 of passages to openings 694, 696.

Figure 27:
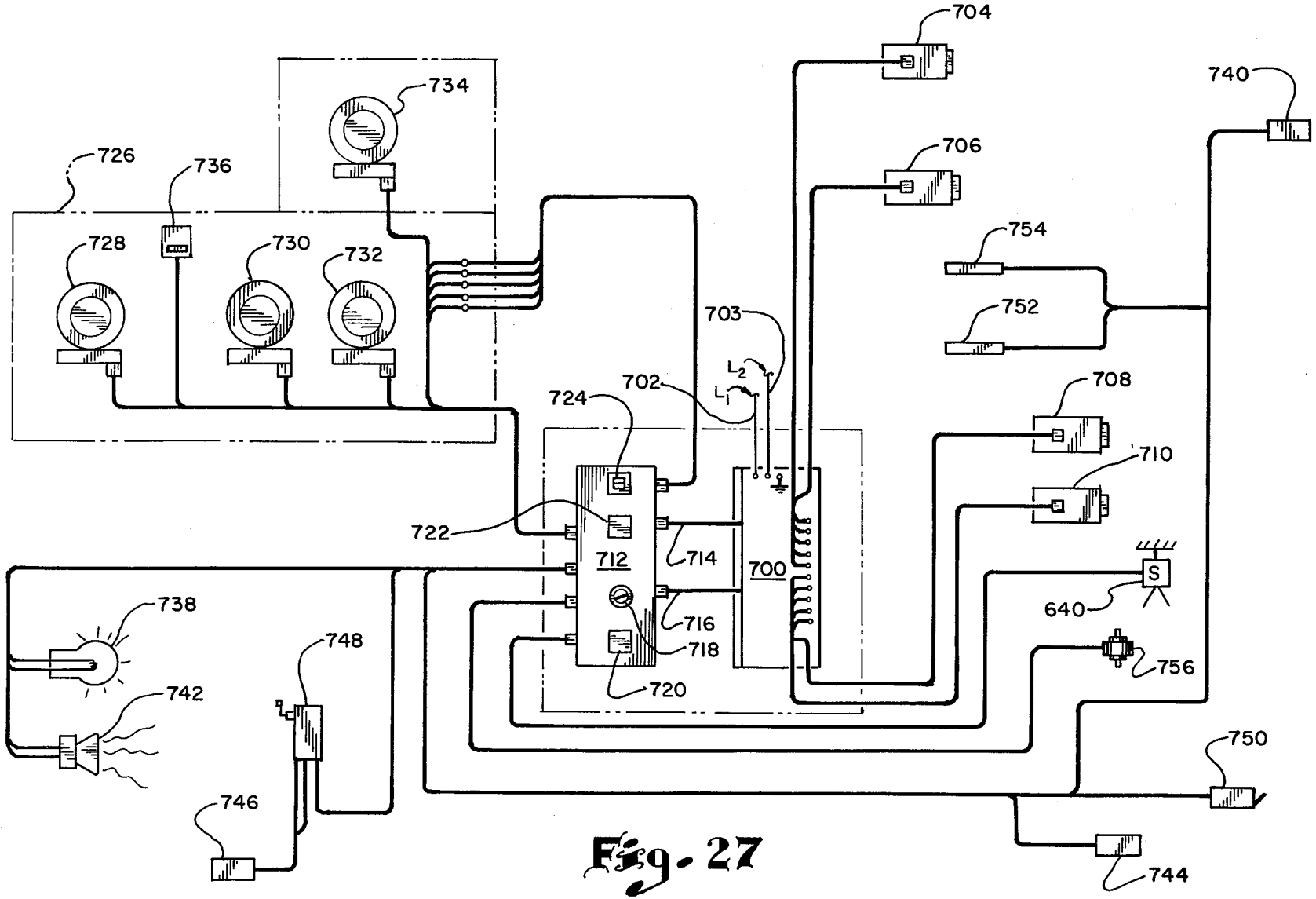
FIG. 27 is a schematic illustration of a preferred embodiment of a control system.

FIG. 27 schematically illustrates a presently preferred electrical control system and method of operation of the apparatus of FIGS. 14–26. A power module 700 is connected to an electrical power source through lines 702, 703 and supplies electrical power to a ½ HP conveyor motor 704 for belt conveyor means 434, a 2 HP crusher motor 706, a ½ HP air classifier motor 708 for blower means 440, and a 5 HP storage hopper motor 710 for blower means 508. A control module 712 is connected to the power module by lines 714, 716 and has a manually adjustable calibration means 718, a token per pound setting means 720, a cash per pound setting means 722, and a diagnostic readout means 724. The control module is connected to a coin dispensing means such as a conventional coin dispenser unit 726 including electrically operable penny, nickel and quarter storage and dispensing mechanisms 728, 730, 732. The control module may also be alternatively connected to a conventional token dispensing mechanism 734. A pound counter device 736 may be provided to record the number of pounds of aluminum cans processed during operation of the machine. A storage bin full light means 738 is connected to the control module and a bin full sensor means 740 to indicate a bin full condition which requires removal of crushed aluminum cans in bin means 404. An audible steel can alert means 742 is connected to the control module and a steel can sensor means 744, associated with the steel can discharge chute, to indicate to the customer that steel cans have been processed. A start sensor means 746 is connected to the control module through a door actuated limit switch 748 which prevents operation whenever any of the access doors are open. An override switch 750 is connected to the control module to prevent operation of the machine by a customer when the storage bin means is being unloaded. A crusher jam sensor means 752, operable in response to lack of completion of motion of the crusher blade, and a crusher bridge sensor means 754, operable in response to filling of the crusher hopper, are connected to the control module. A weigh hopper door actuating motor means 756 and the load cell means 640 are directly connected to the control module.

In operation, a customer usually dumps a bag or boxload of cans into the feed hopper and presses the start button which energizes the ½ H.P. conveyor motor, the ½ H.P. air classifier fan motor, the 2 H.P. crusher motor, the ½ H.P. classifier belt motor, and the 5 H.P. storage hopper fan motor. Cans in the feed hopper are normally carried upwardly by the inclined can conveyor in groups of four to six cans located in the spaces between the ribs which are preferably inclined at an angle of between approximately 25° to 60° so that each can is normally separately sequentially discharged at the top of the can conveyor into the opening in the adjacent inclined relatively short length air chute by momentum and gravity forces. Empty cans are carried upwardly in the inclined portion of the air chute, normally in sequential spaced relationship, and then laterally across the laterally extending portion of the air chute by the force of the pressurized air therewithin. Objects which are heavier than empty cans fall by gravity through the air stream into the discharge opening and down the chute to the storage bin. Empty cans in the lateral discharge portion of the air chute are moved into the crusher by gravity and pressurized air forces. The upper portions of the air chute above the can inlet opening are preferably covered by a mesh screen material. The side walls of the crusher housing are substantially closed and form a continuation of the air chute so that some pressurized air flows downwardly therethrough from the laterally extending portion of the air chute whereby a continuous air flow path is provided from the can inlet opening opposite the conveyor to and through the crusher. The empty cans normally enter the crusher in sequential vertically spaced relationship and are crushed a few (e.g. 2 or 3 a side) at a time in the crusher and fall from the crusher essentially one at a time in sequential vertically spaced relationship by gravity force onto the separator belt which is mounted in a substantially closed separator belt housing having side walls coplanar with and forming an extension of the side walls of the crusher housing. Crushed aluminum cans are carried one or a few at a time over the upper portion of the magnetic drum and aluminum cans are discharged from the conveyor belt by momentum and gravity forces for free fall into the weigh hopper. Crushed steel cans are held on and are carried one at a time around the magnetic drum by the conveyor belt due to magnetic force until the upwardly inclined lower portion of the belt leaves the magnetic field of the drum whereat steel cans fall downwardly away from the belt by gravity force into the downwardly outwardly inclined chute therebelow which guides steel cans to the storage bin. The crushed aluminum cans are collected in the weigh hopper until there is a predetermined maximum weight of aluminum cans or there has been no change for a predetermined period of time in the weight of aluminum cans in the weigh hopper, whichever condition is first to occur. The weight of aluminum cans in the weigh hopper is continuously measured from analog type signals continuously generated by the load cell and transmitted to an analog to digital converter in the control module. In order to assure very accurate measurements of the weight of crushed aluminum cans received in the weigh hopper and dispensation of the proper amount of compensation to the customer, the load cell weight signals are converted to a resolution of 1/4000 parts whereby each digital output signal equals approximately 0.00625 pounds. All weight measurements are based upon averages of multiple (e.g. 16 ) discreet individual weight signals to reduce any possibility of error due to false information. When a process cycle is initiated by pushing the start button, the load cell immediately begins transmitting signals to the converter to establish an averaged initial weight condition of the weigh hopper which, in the presently preferred embodiment, has an empty weight of approximately 20 pounds and a full condition can weight capacity of approximately 4 to 5 pounds or approximately 96 to 120 crushed aluminum cans. In the presently preferred system, two consecutive identical average initial weight output signals are required within a predetermined time period, e.g. 30 seconds, to enable the machine operation to begin and, if such output signals are not generated, the machine will not function until suitable adjustments or repairs have been effected. The initial weight data is stored and subsequently used to determine the weight of aluminum cans subsequently received in the weigh hopper. In the presently preferred embodiment, the initial weight is automatically reduced by 0.0125 pound to negate possible errors due to design tolerances. If a satisfactory average initial weight output signal is generated, the various motors are energized as previously described and a can processing cycle is initiated which, in the presently preferred embodiment, requires approximately 30 to 40 seconds for each empty aluminum can to be transported from the infeed hopper to the weigh hopper. After the can processing cycle is initiated, the load cell is periodically automatically monitored at relatively short time intervals, e.g. approximately 30 to 40 seconds, to determine the weight change in the weigh hopper due to receipt of empty aluminum cans therewithin. If there has been no weight change after a predetermined time delay, e.g. 40 to 50 seconds, a transaction complete signal is generated and the machine operation is terminated. As long as a weight change is detected, the machine continues to operate until such time as a no-weight change signal is generated or a maximum weight signal (e.g. 4 pounds) is generated whereupon the conveyor motor, air classifier fan motor, crusher motor, and separator belt motor are deenergized. A final gross weight measurement is made which requires two consecutive identical average weights. Then, the stored initial weight data is electronically subtracted from the final gross weight data to generate a net weight signal which is converted from digital units to hundredths of pounds and then multiplied by a predetermined price per pound to generate a dispensing signal which actuates the coin dispensing mechanism. In the presently preferred system, the coin dispenser is operable to dispense quarters, nickels and pennies. Whenever the amount to be dispensed exceeds 25 cents, the coin dispenser is actuated to dispense a quarter before any additional amounts are dispensed. In addition, if the net weight calculation results in an uneven amount due, such as 10.3 cents, the system may be designed to pay an additional penny so that the customer never receives less than the full value of the empty aluminum cans received in the weigh hopper. In order that a customer may be made aware that one or more of the cans is a steel can, an audible warning device is actuable by a sensing device in the steel can discharge chute.

After completion of weighing and coin dispensing sequence of operation, a dump signal is generated to cause actuation of the weigh hopper doors from the closed position to the open position. By using a stepping motor, the weigh hopper doors are gradually opened so as to control the rate of movement and the number of crushed aluminum cans dropped into the inlet opening of the discharge air chute therebelow. In this manner, the crushed cans may be dropped substantially a few at a time to prevent jamming in the air chute. The unloading fan operates continuously during each process cycle to convey the crushed aluminum cans through the horizontal air chute, past the diverter plate, and upwardly through the vertical air chute into the relatively large (e.g. 3000 pound) storage chamber.

In order to unload crushed aluminum cans from the storage chamber, the diverter plate is moved to the upper position. The access doors are opened and the unloading tray is pulled out from beneath the storage chamber to the unloading position. One end of a flexible conduit is connected to the discharge opening of the air chute in the unloading tray and the other end is connected to a carrier such as a truck. The air blower is actuated to create a flow of pressurized air to the carrier. Crushed aluminum cans are pulled from the storage chamber into the tray by use of a rake or the like while the access doors form guide walls on opposite sides of the tray. The cans fall into the air chute through the inlet opening in the tray and are transported to the carrier by the air stream in the flexible conduit extending between the tray and the carrier. A "storage full" indicator light may be mounted on the control panel and connected to a sensor in the storage chamber which can also override the start button and prevent operation of the process module when the storage module is full.

The presently preferred embodiments of the invention provide several advantages over prior art apparatus. First, the can feed conveyor ribs are on an angle of between 20 to 45 degrees (30° being presently preferred) to enable the cans to be metered into the air classifier as previously described. One rib on the belt is on a horizontal plane so that the last can in the hopper will be removed if not removed by the inclined ribs.

The crusher has an oscillating plate which crushes steel and aluminum cans on each side on each half stroke. Each can is normally impacted two or three times by the plate as the can moves downwardly through the crusher. The half stroke crushing motion helps balance the load on the crusher and also allows for a more efficient operation. Due to the single can filing effect (i.e. separation of cans) of the feed conveyor, the crusher has a continuous feed which allows the crusher to run in a most efficient mode. The crusher uses a proximity sensor to monitor the motion of the crusher plate. In case of a blockage in the crusher, the sensor will detect this stoppage and reverse the motor. This reversing action in most cases will unjam any blockage that could occur in the crusher. The motor will reverse three times in an effort to unjam itself. However, if the jam will not dislodge the machine will shut down. The crusher has a feed hopper made of plastic. The feed hopper will allow cans to build up during crusher reversing. The crusher feed hopper has a capacitance sensor in the top portion which will shut down the machine in the event of a can bridge caused by buildup of cans in the hopper.

The magnetic separation system consists of a magnetic drum and idler pulley. A conventional belt with one rib is driven around the drum and idler pulley. Steel and aluminum cans fall onto the magnetic separator belt, the aluminum cans fall off of drum into the weigh hopper, steel cans are held to the magnetic drum and then drop onto a steel can discharge chute. The rib on the belt will discharge any steel can that might be held on the belt. A capacitance sensor is located at the end of the steel can discharge chute which indicates that steel cans are being rejected by energizing the steel can buzzer alert. The steel can sensor also functions as a steel container full indicator. When the steel container is full, steel cans back up into the steel chute and the steel can reject sensor is covered for a prolonged time, the control system will allow the transaction underway to finish and then shut down the machine until the steel cans are removed.

The weigh hopper is close-coupled, e.g. about 1 inch support beam to the load cell to ensure that the weigh hopper will not move around or oscillate as cans are being deposited therein from the crusher. When the 5 pound limit is reached, the weigh hopper doors will open. These doors are driven by a stepping motor and are programmed to open at a controlled rate as indicated by the following chart:

OPEN-CLOSE ACTUATION TIME, SECONDS

| | | | | | | |
|---|---|---|---|---|---|---|
| Open | | | | | | |
| Stage One | 34.9 | Steps/Sec. × | 2.87 | Sec. = | 100 steps |
| Stage Two | 25 | Steps/Sec. × | 4 | Sec. = | 100 steps |
| Stage Three | 10 | Steps/Sec. × | 10 | Sec. = | 100 steps |
| Close | 349 | Steps/Sec. × | 8.6 | Sec. = | 300 steps |
| | | | 25.47 | Sec. | 600 Steps |

The weigh cycle of the presently preferred embodiment also provides special advantages and features. All incoming weights from the load cell are converted by the A to D converter to a resolution of 1 part in 4000 over the 25# range, or to discrete weight increments of 0.00625# (i.e., one digital unit equals 0.00625#). When a weight value is provided by the system, it is an averaged weight which means that 16 individual weights were added and then averaged by dividing by 16. This is done to reduce any possibility of error due to electrical noise, and to ensure repetition and accuracy. Each time the apparatus is started by touching the start sensor, an averaged weight of the empty weight hopper is calculated. Two consecutive averaged weights must be identical before the system will proceed. If this condition cannot be met within 30 seconds, the machine will be taken out of service. This tare value is saved for later use and is reduced by 0.0125# to negate any error caused by truncation and to give the customer a slight advantage when the tare figure is used to figure the final weight.

After a time delay, the load cell means is monitored to detect an increase in the gross weight. If there has been no increase in the weight or the net hopper weight equals approximately 5 pounds, the system makes a final average weigh to determine gross weight. The final gross weight value must be two consecutive averaged weights which are identical. Then tare weight is subtracted from the gross weight to give the net weight.

The net weight value is converted from digital units to hundredths of pounds and then multiplied by the price per pound to determine the final payout. If the payout calculated above is equal to zero, but the net weight is equal to or greater than 0.01875 pounds (approximately equal to 3/7 of a can), then the system will make a one cent payout. This feature will ensure a minimum one cent payout on a can, regardless of the price per pound.

The start sensor is a conventional capacity proximity switch for ease of cleaning and also to reduce maintenance. The aluminum storage bin full sensor is a capacity proximity switch which is mounted in an upper corner of the aluminum storage bin which, when actuated, will turn the machine off after the next complete cycle. The steel full sensor is a capacity proximity switch which is mounted at the end of the steel discharge chute. The sensor will give an audio signal to the customer to indicate when steel is being deposited. The steel sensor will also turn the machine off if the steel sensor is covered for a prolonged period of time which would indicate that the steel can hopper is full.

The crusher bridge condition sensor is located above the crusher. This sensor will detect and shut down the machine in the event of a can buildup above the crusher. The crusher jam sensor monitors the motion of the crusher in the event of a crusher jam (or stall motor). This sensor will detect the stoppage of crusher linkage and will reverse the crusher motor. In most cases, this will unjam the crusher. This sequence is repeated three times. If the crusher will not unjam due to reversals of the crusher motor, the machine will turn off. The crusher jam sensor is also used to time the microprocessor. It supplies timing pulses to the control module. An out of service light is energized when a fault is sensed and flash after the transaction underway is completed. When the out-of-service light is flashing, the machine will be taken out of service and repaired.

The machine controls consist of two basic elements: a low voltage control module (LVM) and a high voltage power module (HVM). The HVM contains the power supply, switching relays and all high voltage termination. All motors are controlled from the HVM (except the weigh hopper motor). Also an outside area light is powered from this module. The 230 volt single phase input power source is connected to the HVM.

The LVM contains a microprocessor, low voltage switching relays, all input/output for processor calibration, current price and token setting switches and error code readout (ECR). The price per pound is set on the LVM chassis using thumb wheel switches. The range is 0.03 to 0.99 cents per pound. The 0.00, 0.01 and 0.02 cents settings are used as part of the self-diagnosis test. These settings will be discussed under self-diagnostics.

To calibrate the machine, the power is turned off at a toggle switch located on the HVM chassis. The price per pound switch is set at 0.00 cents per pound and power restored so the LVM is in the calibration mode. The calibration readout (CCR) is connected to a calibration connector located on the side of the LVM chassis. The readout will give the gross weight of the weigh hopper and weighing mechanism. The weigh hopper must be stable and not moving when making the gross reading. Then, the gross weight from the CCR is recorded. Then a 5 pound weight standard is set into the weigh hopper. The weigh hopper is allowed to settle down and, then the calibration potentiometer located on the LVM chassis is adjusted so that the new gross weight reading is the total of gross weight of the empty weigh hopper plus the five pound added weight. This calibration procedure is repeated until two consecutive readings are obtained. Then, the CCR module is disconnected and the price per pound switch is reset to the desired payout.

A single digit error code readout is located on the LVM and the readout is used as an aid in diagnosing problems with the machine. There are eleven readouts from this single digit ECR as follows:

Blank—No error conditions

0—Electrical noise on input sensor lines or power failure.

1—One or more of coin/token changers is out of coin/or token; or one of the changers is jammed.

2—Aluminum storage full or aluminum storage full sensor fail.

3—Steel storage full or steel storage full sensor fail.

4—Scale weigh out of limits, A to D converter failure or load cell fail.

5—Interim memory (RAM or PROM) failure.

6—Scale will not tare (Tare check every 25 sec.) Two consecutive readings out of 15 must occur back to back.

7—Crusher jam or crusher jam sensor fail.

8—Motor overload trip.

9—Crusher bridge, crusher bridge sensor failure or unloading blower switch in unloading position.

There are five different states the control can be in. Each state will allow certain ECR to readout. The following is a list of state and corresponding ECR readouts with their meanings.

(1) State #1—Power is first turned on. After power has been turned on, the processor goes through an internal memory check (internal RAM and PROM). This check must be completed three consecutive times. After this test is completed, the steel buzzer will sound and the storage blower energizes for a short period of time (approximately five seconds). The weigh hopper doors open and purge out any cans that might be in the hopper or air ducts. When the purge cycle is complete, the weigh hopper doors close and the storage blower motor deenergizes. After the power up cycle is complete, the control will now check for electrical noise on all input sensors and for microprocessor failure. After this check is complete, the machine is ready for customer services. During the power up cycle, there are two error readouts that can occur.

ECR 5—during power up internal memory check indicates an internal memory (RAM or PROM) failure. The low voltage module should be replaced.

ECR 0—After power up cycle is complete, this code indicates there is electrical noise on the sensor input lines or microprocessor failure. Sensor problems should be corrected or replace the low voltage module.

(2) State #2—Machine not running, ECR blank and no alarm (red light on). The following is a list of ECR that are being monitored. Any of these conditions will cause the machine to go into alarm and be taken out of service.

ECR 2—Aluminum storage full or aluminum storage full, sensor fail.

ECR 3—Steel storage full or steel storage full, sensor fail.

ECR 4—Scale weight out of limits, A to D failure or load cell failure.

ECR 6—Scale will not tare

ECR 9—Crusher bridge, crusher bridge sensor failure or unloading blower switch in unloading position.

(3) State #3—Machine running, ECR blank and no alarm (red light on). The following is a list of ECR that are being monitored. Any of these conditions will cause the machine to go into alarm and be taken out of service.

ECR 1—One or more of coin/token changers is out of coin/tokens or one of the changers is in a jam condition.

ECR 7—Crusher jam or crusher jam sensor fail.

ECR 8—Motor overload trip (motors have automatic resets).

(4) State #4—This state is to be used as a tool by the service technician or services person. Turn the power off at toggle switch located on the HVM chassis. Set the price per pound switch at 0.01 cents per pound and restore power. The machine is now in slow cycle. It will require 8 minutes for the machine to complete one weigh cycle. The slow cycle can be used for making the following types of checks: coin changer checks, buzzer checks, ampere readings on motors, all sensor checks, making conveyor belt adjustments, making steel separator adjustments, check the air classifier and the weight hopper motor mechanism, checking any mechanical function that requires the machine to be running, etc.

(5) State #5—This state is to be used as a tool by the manufacturer (factory) for checking and preparing the LVM. Turn the power off at the toggle switch located on the HVM chassis. Set the price per pound switch at 0.02 cents per pound and restore power. The LVM can now be connected to a display (RS 232 or CRT readout). This state allows the A to D converter to be checked in detail such as taking 16 weight readings divided by 16 to check individual weight readings, stability of the A to D can also be checked in this mode. This state should only be used by a manufacturer's representative.

It is to be understood that various concepts illustrated in particular embodiments of the invention may be used in other embodiments of the invention. In addition, it is intended that alternative embodiments of the invention be included within the scope of the claims except insofar as limited by the prior art.

What is claimed is:

1. Apparatus for receiving aluminum and steel cans and dispensing compensation for at least the aluminum cans comprising:

inlet hopper means for receiving a quantity of cans;

upwardly inclined conveyor means for receiving the quantity of cans and carrying the cans upwardly to a first discharge area;

air duct means mounted in an upwardly inclined position beneath and in juxtaposition to the upper portions of said conveyor means for receiving all cans from said conveyor means and having an inlet opening means located next adjacent said conveyor means and a first lowermost outlet opening means for receiving cans above a predetermined minimum weight and a second uppermost outlet opening means for receiving can below a predetermined minimum weight;

pressurized air means for creating a stream of high pressure air flowing upwardly through said air duct means for carrying the cans below the predetermined weight to said second uppermost outlet opening means while enabling passage of cans above the predetermined minimum weight to said first lowermost outlet opening means;

aluminum and steel can crusher means connected to said second outlet opening means for receiving aluminum and steel cans from said air duct means and for crushing aluminum and steel cans therein;

separating means located below said crusher means for receiving crushed aluminum and steel cans therefrom and for separating crushed aluminum cans from crushed steel cans;

weighing means located below said separating means for receiving crushed aluminum cans therefrom and for weighing the crushed aluminum cans received therefrom and for generating a signal indicative of the weight of the crushed aluminum cans received therein;

hopper means located below said separating means for receiving crushed aluminum cans from said separating means;

compensation dispensing means operable in response to generation of said signal for dispensing compensation for the total weight of crushed aluminum cans;

all of said aforementioned means being mounted in a relatively small process module;

a relatively large size storage module means being attached to one side of said process module for storage of crushed aluminum cans; and transport means for transporting crushed aluminum cans from said hopper means to said storage module means.

2. The invention as defined in claim 1 and wherein:

said conveyor means comprising a continuous belt conveyor having a lower end portion located below said inlet hopper means and an upper end portion located above said inlet hopper means.

3. The invention as defined in claim 2 and wherein:

said conveyor means and said crusher means and said separator means being located in juxtaposition to one another and being driven by a single electric motor.

4. The invention as defined in claim 1 and wherein:

said separator means comprising a continuous belt with magnetic means for holding crushed steel cans thereon after crushed aluminum cans have been discharged therefrom.

5. The invention as defined in claim 1 and wherein:

said crusher means comprising an oscillating plate member pivotally mounted between oppositely inclined spaced crushing plate members.

6. The invention as defined in claim 1 and wherein said weighing means comprising:

a hopper means for receiving and holding crushed cans; and a load cell means for supporting said hopper means and generating a signal indicative of the weight of crushed cans held in said hopper means.

7. The invention as defined in claim 1 and wherein said crusher means comprising:

a pair of continuous belt members which are relatively inclined to define a passage therebetween of gradually reduced width.

8. The invention as defined in claim 1 and further comprising:

a duct system and air blower means for transporting crushed aluminum cans from said hopper means to a discharge station.

9. The invention as defined in claim 8 and further comprising:

a duct system and air blower means for transporting crushed steel cans from said second hopper means to a steel can discharge station.

10. The invention as defined in claim 1 and further comprising:

a duct system for transporting crushed aluminum cans to a storage bin means in said storage module means;

a first portion of said duct system being connected to said hopper means;

a second portion of said duct system being connected to said storage bin means;

a third portion of said duct system being connected to a discharge station associated with said storage bin means;

a single air blower means being selectably connectable to said first portion and said second portion and said third portion of said duct system; and valve means associated with said duct system for selectively connecting said air blower means to said second portion and said third portion of said duct system.

11. Apparatus for return and processing of used containers including aluminum and steel cans and bottles and the like and for dispensing compensation for at least empty aluminum cans suitable for recycling comprising:

housing means for enclosing the apparatus;

compensation dispensing means on said housing means for dispensing compensation for at least empty aluminum cans;

inlet means on said housing means for receiving used containers;

an upwardly inclined elongated continuous belt-type container conveyor means located in said housing means adjacent and being connected to said inlet means upwardly conveying used containers within said housing means;

bin and chute means connected to said inlet means and operatively associated with said container conveyor means for continuously locating containers on said conveyor means;

an air blower means mounted in said housing means for generating a flow of pressurized air for conveying empty aluminum and steel containers;

an air duct means connected to said air blower means and mounted in said housing means adjacent said container conveyor means and extending upwardly in generally parallel relationship thereto for establishing an air stream therein causing upward movement of empty aluminum and steel containers therewithin;

a container inlet opening means in said air duct means on one side of said air stream located therewithin and being located adjacent and below the upper end portion of said container conveyor means for receiving containers discharged therefrom by gravity and momentum forces;

a heavy article outlet opening means in said air duct means located below said container inlet opening means on the opposite side of said air stream for receiving heavy articles such as bottles and filled aluminum and steel containers by gravity fall through said air stream from said container inlet opening means;

an empty aluminum and steel can crusher means located in said housing means above and being connected to said air duct means for receiving and crushing empty aluminum and steel cans;

an empty crushed aluminum and steel can separator means located in said housing means adjacent said crusher means for separating crushed aluminum cans from crushed steel cans;

a crushed aluminum can weighing means located in said housing means adjacent said separator means for receiving and weighing crushed aluminum cans and for generating a signal to cause dispensation of compensation by said compensation dispensing means;

a crushed aluminum can storage bin means located in said housing means adjacent said weighing means for receiving and storing crushed aluminum cans after weighing thereof;

a crushed aluminum can discharge duct means located in said housing mean and being associated with said weighing means for receiving crushed aluminum cans therefrom and connected to said storage bin means for conveying crushed aluminum cans thereto;

a second air blower means connected to said crushed aluminum can discharge duct means for generating a stream of pressurized air therewithin sufficient to blow crushed aluminum cans from a location adjacent said weighing means to said storage bin means;

and wherein said crushed aluminum can discharge duct means comprises:

a horizontally extending duct portion connected to said weighing means and said second air blower means; and a vertically extending portion located in said storage bin means and having a discharge opening means located above a bottom wall of said storage bin means for discharging crushed aluminum containers into said storage bin means by gravitational forces;

and further comprising:

a storage bin discharge opening connected to said storage bin means;

an unloading duct means located below said bottom wall of said storage bin means and being connected to said storage bin discharge opening for conveying crushed aluminum cans from said storage bin means to an unloading discharge opening adjacent a side wall of said housing means; and said unloading duct means being selectively connectable to said second air blower means for generating a stream of pressurized air therewithin for blowing crushed aluminum cans from said storage bin means to said unloading discharge opening.

12. The invention as defined in claim 11 and wherein said crusher means comprising:

a pair of continuous belt members mounted in side by side juxtaposition and defining an elongated slot of gradually decreasing width therebetween which has a relatively large can inlet opening at one end thereof of sufficient width to receive uncrushed aluminum and steel cans and a relatively small can outlet opening at the other end thereof of sufficient width to reduce the size of aluminum and steel cans to a predetermined minimum size by crushing between said belt members.

13. The invention as defined in claim 12 and wherein said air duct means being connected to said relatively large can inlet opening of said slot between said belt members for enabling empty aluminum and steel cans to be blown into and along said slot by said air stream in said air duct means.

14. The invention as defined in claim 13 and wherein said belt members being mounted above said duct means and located in upwardly and outwardly inclined relationship relative thereto and providing crushed can discharge means at an upper end of said belt members for outwardly and downwardly discharging crushed aluminum and steel cans by momentum and gravitational forces.

15. The invention as defined in claim 14 and wherein said separating means being located adjacent and below said upper end portion of said belt members for receiving the crushed aluminum and steel cans from said crusher means by gravity fall therefrom.

16. The invention as defined in claim 15 and wherein said separating means comprising:

a continuous belt-type conveyor member mounted in a horizontally extending position; and a magnetic pulley means at one end of said belt-type conveyor member for causing crushed steel cans to be carried thereabout on said belt member and discharged from said belt member therebeyond and enabling discharge of crushed aluminum cans from said belt member by momentum and gravitational forces prior to discharge of crushed steel cans.

17. Apparatus for processing and storing empty aluminum and steel cans and dispensing compensation for the value of processed empty aluminum cans comprising:

(a) a process module of relatively small size and shape which contains:

(1) an inlet means for receiving cans;

(2) an upwardly inclined conveyor means for transporting cans from said inlet means to an elevated discharge position;

(3) an upwardly inclined air duct means located adjacent said elevated discharge position for receiving empty aluminum and steel cans from said conveyor means at said elevated discharge position;

(4) an air blower means mounted below and being connected to said upwardly inclined air duct means for separating empty aluminum and steel cans from other articles by creating a pressurized air stream in said duct means sufficient to transport said empty aluminum and steel cans upwardly in said duct means to a discharge opening in said air duct means located adjacent the upper wall of said process module;

(5) a crusher means mounted directly below said discharge opening in said air duct means for receiving and crushing empty aluminum and steel cans;

(6) separator means mounted directly below said crusher means for receiving crushed aluminum and steel cans from said crusher means and for separating crushed aluminum cans from crushed steel cans;

(7) weighing means mounted directly below said separator means for receiving crushed aluminum cans from said separator means and for generating a signal indicative of the weight of aluminum cans received therein;

(8) compensation means mounted on an exterior wall of said process module adjacent said inlet means for dispensing compensation in response to said signal;

(9) an horizontally extending air duct means mounted on the floor of said process module directly below said weighing means for receiving crushed aluminum cans from said weighing means; and

(10) a second air blower means mounted on the floor of said process module and being connected to said horizontally extending air duct means for transporting crushed aluminum cans away from said process module in said horizontally extending air duct means by creating a pressurized air stream therein; and (b) a storage module of relatively large size and shape attached to one side of said process module which contains:

(1) a storage chamber means for receiving and storing crushed aluminum cans from said process module;

(2) an horizontally extending air duct means located adjacent a bottom wall of said storage chamber means and connected to said horizontally extending air duct means in said process module for receiving and transporting crushed aluminum cans therefrom;

(3) a vertically extending air duct means in said storage chamber means and being connected to said horizontally extending air duct means in said storage module for receiving and transporting crushed aluminum cans into an upper portion of said storage chamber means; and unloading means associated with said storage module for removing crushed aluminum cans from said storage chamber means.

18. The invention as defined in claim 17 and wherein: said process module being of rectangular shape; and said storage module being of square shape.

19. The invention as defined in claim 17 and wherein said unloading means comprising:

a can unloading air duct means mounted below the floor of said storage chamber means and being connected to said air blower means in said process module for receiving crushed aluminum cans from said storage chamber and transporting crushed aluminum cans from said storage module to a remote location.

20. The invention as defined in claim 19 and wherein said unloading means further comprising:

a movable diverter valve means associated with said can unloading duct means and said horizontally extending duct means for alternately selectively connecting said air blower means to said can unloading duct means and said horizontally extending duct means.

21. The invention as defined in claim 17 and wherein said unloading means further comprising:

a box means slidably mounted beneath the floor of said storage chamber means for movement between a retracted position inside said storage module and an extending position outside said storage module;

air duct means in said box means connected to said air blower means in said process module for receiving crushed aluminum cans in said storage chamber means and transporting crushed aluminum cans away from said storage module; and movable door means on said storage module associated with said box means for enabling movement of crushed aluminum cans from said storage chamber means to said air duct means in said box means.

22. A method of processing empty aluminum and steel containers being returned for compensation comprising:

placing the aluminum and steel containers in an inlet opening in a housing containing container processing apparatus;

transporting the aluminum and steel containers vertically downwardly in the housing by gravity to a first location adjacent the bottom of the housing;

transporting the aluminum and steel containers vertically upwardly in the housing by a mechanically operable conveyor means from said first location to a second location intermediate the bottom of the housing and the top of the housing:

discharging the aluminum and steel containers from the conveyor means at said second location by momentum and gravity forces along a lateral outward and downward path into a pressurized air stream in air duct means laterally spaced from said conveyor means;

transporting only empty aluminum and steel containers upwardly laterally and outwardly in said air stream from said second intermediate location to a crusher means at a third location intermediate the bottom of the housing and the top of the housing;

crushing both empty aluminum and steel cans in the crusher means;

downwardly discharging crushed aluminum and steel cans from said crusher means by gravity force toward a separator means at a fourth location beneath the crusher means;

catching crushed aluminum and steel cans on the separator means;

separating crushed aluminum and steel cans on the separator means and laterally outwardly downwardly discharging the crushed aluminum cans by gravity and momentum forces in a first direction and laterally outwardly downwardly discharging the crushed steel cans in a second direction by gravity and momentum forces;

catching crushed aluminum cans in a weigh hopper means at a fifth location beneath the separator means;

weighing the crushed aluminum cans in the weigh hopper means;

generating a signal representative of the weight of crushed aluminum cans in the weigh hopper means;

dispensing compensation for the weight of aluminum cans;

downwardly discharging the crushed aluminum cans from the weigh hopper means by gravity into a can discharge air duct means located along the bottom of the housing means at a sixth position beneath the weigh hopper means; and transporting crushed aluminum cans by a pressurized air stream in the can discharge air duct means along the bottom of the housing means to a can storage means located at an eighth position laterally to one side of the weigh hopper means.

23. The method as defined in claim 22 and further comprising:

downwardly discharging the crushed steel cans from the separator means by gravity and momentum forces into a steel can discharge air duct means located at an eighth position beneath the separator means along the bottom of the housing; and transporting crushed steel cans along the bottom of the housing means by a pressurized air stream in the can discharge duct means to a can discharge outlet located laterally to one side of the separator means at a ninth position.

24. The method as defined in claim 23 and further comprising:

catching crushed aluminum cans from the separator means in a storage hopper means located between the separator means and the weigh hopper means; and then discharging the crushed aluminum cans into the weigh hopper means by gravity after the completion of a weigh cycle and discharge of the aluminum cans in the weigh hopper means.

25. The method as defined in claim 24 and further comprising:

determining the amount of crushed aluminum cans in the weigh hopper means;

catching crushed aluminum cans from the separator means in the storage hopper means whenever a predetermined maximum amount of cans are present in the weigh hopper means; and passing crushed aluminum cans through the storage hopper means when the amount of crushed aluminum cans in the weigh hopper means is less than the predetermined maximum amount.

26. The invention as defined in claim 22 and further comprising:

continuously simultaneously operating the conveyor means, the crusher means and the separator means until compensation has been dispensed.

27. The method of weighing crushed aluminum cans in a weigh hopper means supported by a load cell means connected to an analog to digital converter means and dispensing compensation to a customer in accordance with the weight of crushed aluminum cans in the weight hopper after a weigh cycle comprising the steps of:

measuring the weight of the weigh hopper means in an empty condition by averaging a first group of discrete hopper weight output signals sequentially received from the load cell means over a predetermined period of time;

comparing the discrete output signals and generating a proceed signal only if at least two consecutive ones of the discrete output signals are identical and generating a stop signal if at least two consecutive ones of the discrete output signals are non-identical;

storing the tare weight signal until the compensation has been dispensed to the customer;

reducing the average weight signal by a predetermined amount to negate any error in calculation of average weight and generating a tare weight signal representative of the average empty weight of the weigh hopper means less the predetermined amount;

initiating discharge of a variable amount of crushed aluminum cans into the weigh hopper means;

means to produce an average weigh hopper weight signal;

comparing successive average weigh hopper weight signals;

generating a proceed signal only if at least two consecutive average weigh hopper weight signals are identical;

generating a stop signal if two identical average weigh hopper signals are not detected within a predetermined period;

reducing said two identical and consecutive average weigh hopper signals by a predetermined amount to negate any error in calculation of said empty weight of said weigh hopper means;

generating a tare weight signal from said two identical and consecutive average weigh hopper signals representative of the empty weight of the weigh hopper means less the predetermined amount;

initiating discharge of a variable amount of crushed aluminum cans into the weigh hopper means;

sequentially generating discrete can-hopper weight output signals received from the load cell means representative of said empty weight of said weigh hopper means plus the net weight of said crushed aluminum cans in said weigh hopper means;

sequentially generating can-hopper weight signals representative of the average of a predetermined number of discrete can-hopper weight signals;

generating a net can weight signal representative of the weight differential between said average can-hopper weight signal and said tare weight signal.

* * * * *

UNITED STATES PATENT AND TRADEMARK OFFICE

CERTIFICATE OF CORRECTION

PATENT NO. : 4,463,844

DATED : August 7, 1984

INVENTOR(S) : Stanley S. Huffman, Jan L. Dorfman, Robert L. Frenkel and Ronald A. Pearce It is certified that error appears in the above-identified patent and that said Letters Patent are hereby corrected as shown below:

Claim 39, Column 32, Line 10, the word -- average -- should be inserted between "generating" and "can-hopper".

Signed and Sealed this

*Twelfth* Day of *February 1985*

[SEAL]

*Attest:*

DONALD J. QUIGG

*Attesting Officer* *Acting Commissioner of Patents and Trademarks*